US007093628B2

(12) United States Patent
Kelly et al.

(10) Patent No.: US 7,093,628 B2
(45) Date of Patent: Aug. 22, 2006

(54) METHOD OF AND APPARATUS FOR FORMING TIMBERS WITH ROUNDED ENDS

(75) Inventors: Rodger L. Kelly, Troy, MO (US); Eugene Toombs, IV, St. Louis, MO (US)

(73) Assignee: Mitek Holdings, Inc., Wilmington, DE (US)

( * ) Notice: Subject to any disclaimer, the term of this patent is extended or adjusted under 35 U.S.C. 154(b) by 38 days.

(21) Appl. No.: 10/380,726

(22) PCT Filed: Oct. 5, 2001

(86) PCT No.: PCT/US01/31235

§ 371 (c)(1),
(2), (4) Date: Mar. 17, 2003

(87) PCT Pub. No.: WO02/28606

PCT Pub. Date: Apr. 11, 2002

(65) Prior Publication Data

US 2004/0250909 A1 Dec. 16, 2004

(51) Int. Cl.
*B27M 3/08* (2006.01)
*B27C 5/06* (2006.01)
*B27B 31/00* (2006.01)
*B65G 19/00* (2006.01)

(52) U.S. Cl. ..... 144/360; 144/41; 144/134.1; 144/218; 144/245.1; 198/728

(58) Field of Classification Search .. 144/245.1–245.4, 144/39, 41, 134.1, 150, 218, 242.1, 2.1, 3.1, 144/360; 29/281.3; 198/728, 732, 733; 83/425.3, 425.4
See application file for complete search history.

(56) References Cited

U.S. PATENT DOCUMENTS

| | | | | |
|---|---|---|---|---|
| 726,673 | A | 4/1903 | Goethe | |
| 1,486,550 | A | 3/1924 | Sherman | |
| 1,565,879 | A | 12/1925 | White | |
| 1,606,313 | A * | 11/1926 | Martenet | 144/137 |
| 1,621,299 | A | 3/1927 | White | |
| 1,630,173 | A * | 5/1927 | Dumont | 144/134.1 |
| 1,696,039 | A | 12/1928 | Kane | |
| 1,881,400 | A | 10/1932 | Edmond | |
| 2,751,944 | A | 6/1956 | Schrag et al. | |
| 2,780,842 | A | 2/1957 | Hess | |
| 2,844,852 | A | 7/1958 | West | |
| 3,072,159 | A | 1/1963 | Warmbrunn | |
| 3,137,899 | A | 6/1964 | Troutner | |
| 3,314,209 | A | 4/1967 | Troutner | |
| 3,345,792 | A | 10/1967 | Chandler | |
| 3,400,509 | A | 9/1968 | Setzer | |
| 3,452,502 | A | 7/1969 | Price | |
| 3,470,924 | A | 10/1969 | Short | |
| 3,537,224 | A | 11/1970 | Troutner | |
| 3,591,995 | A | 7/1971 | Troutner | |
| 3,651,612 | A | 3/1972 | Schmitt | |
| 3,735,787 | A | 5/1973 | Siel | |
| 3,867,803 | A | 2/1975 | Platt | |
| 3,946,532 | A | 3/1976 | Gilb | |
| 3,947,309 | A | 3/1976 | Troutner | |
| 4,005,556 | A | 2/1977 | Tuomi | |
| 4,030,264 | A | 6/1977 | Jackson | |
| 4,100,949 | A * | 7/1978 | Carter | 144/402 |
| 4,193,431 | A | 3/1980 | Wood | |
| 4,243,084 | A | 1/1981 | Moody | |
| 4,274,241 | A | 6/1981 | Lindal | |
| 4,288,961 | A | 9/1981 | Snow, Jr. et al. | |
| 4,294,050 | A | 10/1981 | Kandel | |
| 4,393,637 | A | 7/1983 | Mosier | |
| 4,414,787 | A | 11/1983 | Kappen | |
| 4,516,363 | A | 5/1985 | Beaulieu et al. | |
| 4,782,641 | A | 11/1988 | Manenti et al. | |
| 4,907,325 | A * | 3/1990 | Hsu | 29/33 P |
| 5,037,253 | A * | 8/1991 | Molaro et al. | 409/190 |
| 5,103,880 | A * | 4/1992 | Rice et al. | 144/3.1 |
| 5,649,403 | A | 7/1997 | Haisch | |
| 5,730,195 | A | 3/1998 | Riesmeier et al. | |
| 6,176,060 | B1 | 1/2001 | Kennelly et al. | |
| 6,249,972 | B1 | 6/2001 | Kennelly et al. | |

FOREIGN PATENT DOCUMENTS

| | | |
|---|---|---|
| AU | 730275 | 10/2000 |
| AU | 755778 | 4/2001 |
| CH | 336977 | 4/1959 |
| DE | 558682 | 9/1932 |
| DE | 964 437 | 5/1957 |
| DE | 2 162 323 | 1/1973 |
| DE | 197 56 503 A1 | 6/1999 |

(Continued)

OTHER PUBLICATIONS

European Search Report dated Sep. 10, 2004, For European Application No. EP 01 97 7529, 4 Pages.

*Primary Examiner*—Derris H. Banks
*Assistant Examiner*—Shelley Self
(74) *Attorney, Agent, or Firm*—Senniger Powers

(57) ABSTRACT

The method of forming timbers especially for use as webs in timber roof trusses comprising feeding timbers in a predetermined path with the timbers extending transversely to the direction of feed and, as the timbers are so fed, shaping the ends thereof to rounded form, and apparatus for carrying out said method comprising conveyors for feeding the work, a saw for cutting the timbers to length, and cutters for the end shaping.

33 Claims, 23 Drawing Sheets

FOREIGN PATENT DOCUMENTS

| | | |
|---|---|---|
| EP | 1 142 679 A2 | 10/2001 |
| FR | 1.031.420 | 6/1953 |
| GB | 2 334 231 A | 8/1999 |
| JP | 1-256637 | 10/1989 |
| WO | WO 02/28606 A1 | 4/2002 |
| ZA | 94/7462 | 5/1996 |

* cited by examiner

METHOD OF AND APPARATUS FOR FORMING TIMBERS WITH ROUNDED ENDS

BACKGROUND OF THE INVENTION

This invention relates to a method of and apparatus for forming timbers, for example, U.S. 2×4s, with rounded ends especially for use as web members ("webs") for timber trusses, being particularly concerned with a method of and apparatus for cutting timbers to such length as may be called for, and cutting the ends of the sized (cut to length) timbers to rounded form.

As is well known, timber roof trusses, such as Fink, Howe and Queenpost timber trusses, comprise upper and lower timber chords with timber web members extending therebetween triangulating the space between the chords, the chords and web members (which may be simply termed "webs") being constituted for example by 2×4 timbers fastened together at the panel points (the points where the webs intersect the chords) by nailing plates for example. In much of the timber truss construction in the past, the webs have been fabricated with each end cut off straight at the requisite angle for engagement of the respective end flush with the respective chord (i.e. mitered). This has entailed a great deal of sawing with the requirement for cutting at different angles and the problem of organizing the cut timbers according to the mitering angles. There has been a recent trend toward using timber webs with rounded ends instead of mitered ends, enabling the webs to be assembled in a truss extending at any of a wide range of angles with respect to a chord, in firm contact at a rounded end thereof with a chord. This has led to the desirability of manufacture of webs (e.g. 2×4s) with both ends rounded (i.e. of generally semi-circular conformation) at a relatively high rate of production and at relatively low cost for realization of savings in truss manufacture.

BRIEF SUMMARY OF THE INVENTION

Accordingly, among the several objects of the invention may be noted the provision of a method of and apparatus for forming timbers with rounded ends at a relatively high rate of production and at relatively low cost (low labor cost); the provision of such a method and apparatus for the automatic or semi-automatic production of the timbers with the rounded ends; the provision of such a method and apparatus for production of timbers of different lengths; and the provision of such a method and apparatus for reliable and economical rounded-end web production.

The method of the invention generally comprises feeding work comprising at least one timber which has opposite ends to be rounded in a predetermined path with the work extending transversely to the direction of feed and, as the work is thusly fed shaping the ends to rounded form.

Apparatus of the invention generally comprises a system for feeding work comprising at least one timber which has opposite ends to be rounded in a predetermined path with the work extending transversely to the direction of feed, the apparatus having shapers on opposite sides of said path for shaping said ends to rounded from as the work is thusly fed.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
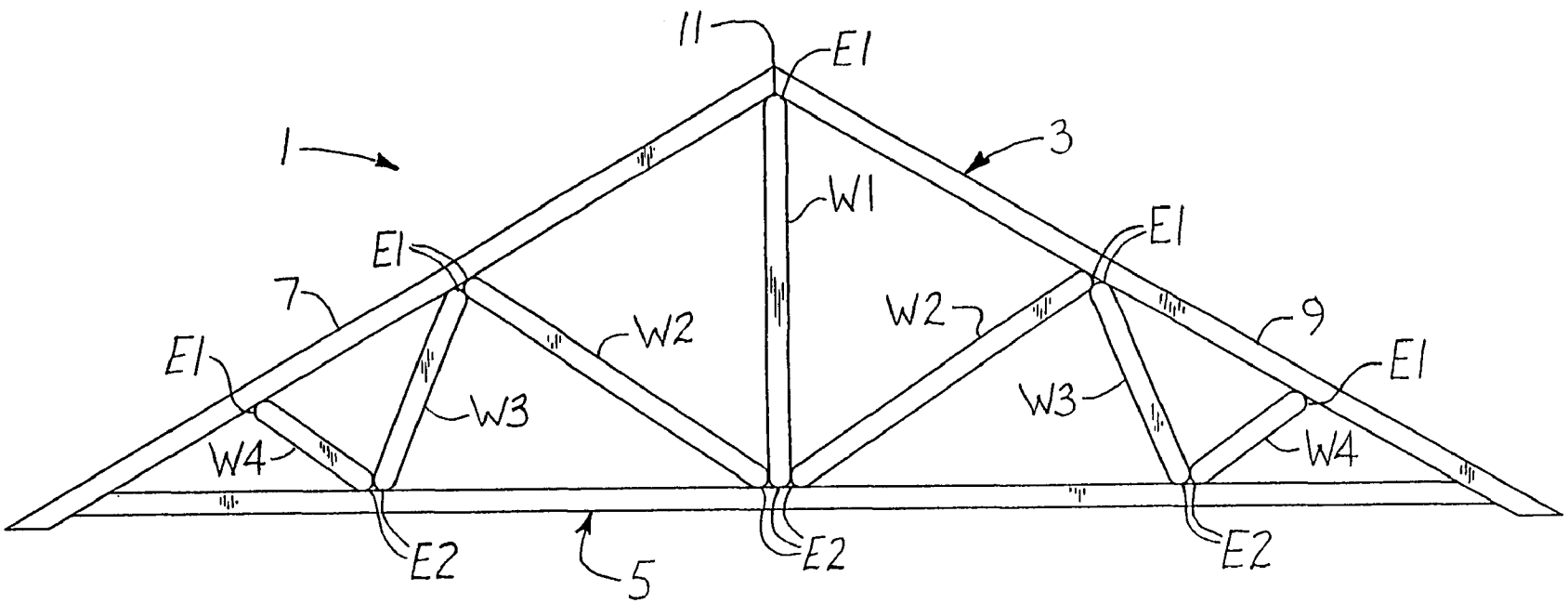
FIG. 1 is a generally diagrammatic view in elevation of a timber truss (a modified Queenpost truss) having rounded end webs such as are the objective of manufacture according to the method and apparatus of the invention; nailing plates used at the panel points of the truss being omitted so as not to obscure the showing of the rounded ends.
Figure 2:
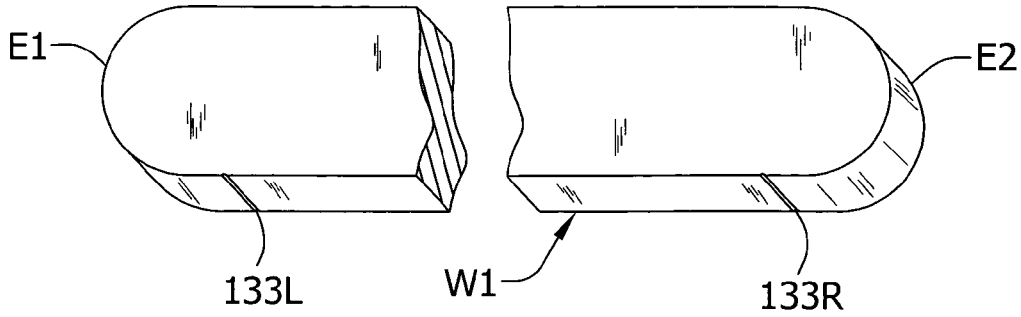
FIG. 2 is a view generally in perspective, and broken away in the middle, of one of the webs, taken generally on line 2—2 of FIG. 3.

Referring first to FIG. 1 of the drawings, there is illustrated a timber truss I, more particularly a modified Queen-post truss, having an upper chord designated in its entirety by the reference numeral 3, a lower chord 5 and webs such as indicated at W1, W2, W3 triangulating the triangular space between the upper chord (comprising inclined timbers 7 and 9 meeting at peak 11) and the lower chord. The lower chord 5, each of the upper chord timbers 7, 9 and each of the webs is constituted, for example, by a length of 2×4 timber (the sides of which, as well understood, being somewhat minus 2" and 4" wide and hence identified as the 2" and 4" wide sides) the 4"-sides of the chords being vertical, the 4"-sides of the webs being in the vertical planes of the 4"-sides of the chords. As illustrated, each web has rounded ends E1, E2 (each of which is curved generally in a semi-circle from one 2"-side to the other of the respective 2×4 in contact with a respective chord member at the respective panel point and fastened thereto by a nailing plate (not shown) in known manner. The nailing plates normally located at the ends of the webs are not shown. All this is illustrated to show how the rounded-end webs W1, etc. are used instead of mitered-end webs, and the format of webs of the type produced by the method and apparatus of this invention. FIG. 2 shows a web such as the web W1 per se with the rounded ends. It is to be understood that the rounded end webs W1 could be used for constructing frames and items other than a roof truss without departing from the scope of the present invention. Moreover, the precise dimensions of the webs W1 could be other than 2"×4". As discussed below, the apparatus of the present invention may be adjusted to accommodate timbers (not shown) of different cross sectional sizes and lengths.

Figure 3:
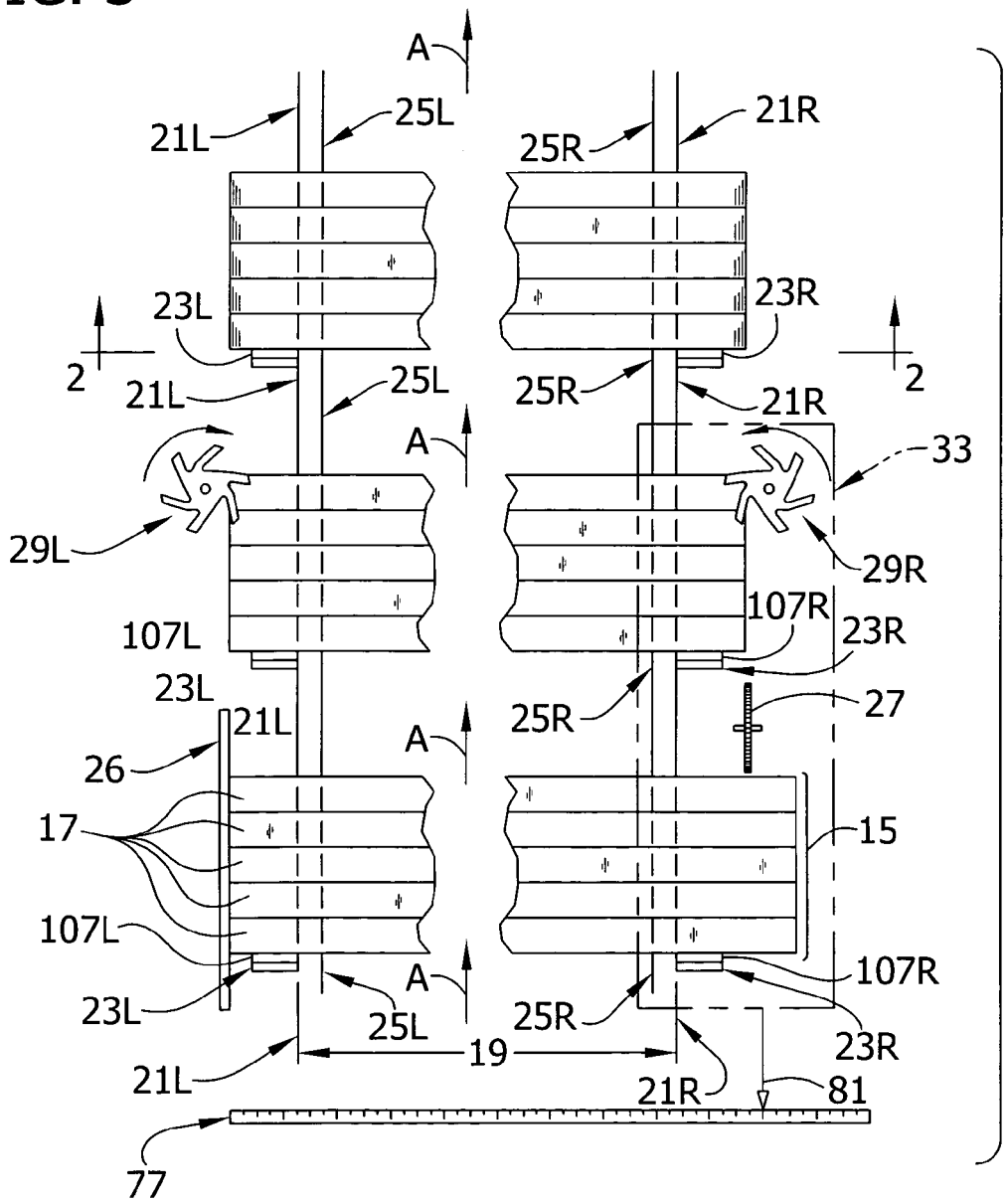
FIG. 3 is a diagrammatic view generally illustrating (in plan) the method and certain components of the apparatus of the invention.

Now referring principally to FIG. 3, the method of this invention for forming timbers with rounded ends is generally diagrammatically shown to comprise feeding work indicated in its entirety at 15, comprising at least one timber 17, and as shown comprising five timbers 17, in a predetermined path as indicated by the arrows A with the work (the timbers 17) extending transversely to the direction of feed. The feed is by means of a work feeding system designated 19 in its entirety in FIG. 3 and comprising two conveyors diagrammatically shown at 21L and 21R each having at least one pusher 23L, 23R engageable with the work adjacent a respective end thereof for pushing the work ahead in the stated path. As will appear, 21L is transversely fixed; 21R is transversely movable. More particularly, each conveyor has a plurality of the pushers spaced at intervals making system 19 a flight conveyor system wherein each flight is adapted for accommodation of a five-timber group (or batch) constituting the work, in which the timbers are organized in engagement with one another with the broad (4"-) sides thereof in face-to-face engagement. As so organized, the five timbers constituting the work are fed (pushed) as a group (or batch) in the direction perpendicular to the broad (4"-) sides of the timbers the work sliding ahead in a generally horizontal plane over left- and right-hand rails 25L, 25R.

The work (the group of timbers 17) is butted up at one end thereof (its left end as viewed in FIG. 3) against a guide or abutment 26 constituted by a plate that may be termed a "locater plate" engageable by said end of the work for locating (positioning) it endwise and guiding it along its said path of travel. As the work is fed (sliding on the rails 25L, 25R), the timbers 17 constituting the work are cut to a predetermined length as by a saw 27 (e.g., a rotary cross-cut saw) rotatable on an axis transverse to the path of feed, the saw being rotatable in a plane perpendicular to the work for sawing off end portions of the timbers which project to the right of the saw as illustrated. The saw is positioned in a plane spaced from the work-end abutment or locater plate 26 a distance corresponding to the selected length for the timbers.

As the work (timbers 17 thereof now having been cut to said predetermined length by the saw 27) continues being fed in said predetermined path, it has both ends shaped to rounded form (semi-circular) by shapers 29L, 29R on opposite sides of the path in which it is being fed. As will be subsequently described in relative detail, each shaper is a rotary cutter generally having blades each having a semi-circular cutting edge for cutting the respective end of each timber 17 to said rounded form, said shapers or cutters 29L, 29R being located directly opposite one another on opposite sides of the work feed path, both ends of each timber being simultaneously cut thereby to the rounded form in a single pass of the work. It is to be understood that the ends may be formed other than at the same time without departing from the scope for the present invention.

In apparatus of this invention as will be subsequently detailed, the conveyor 21R, the saw 27 and the shaper or cutter 29R are transversely movable, being mounted on a carrier or carriage 33 depicted in phantom in FIG. 3 mounted for adjustment toward and away from conveyor 21L (which is transversely fixed) for engagement of the pushers on conveyor 21R with work (timbers 17) of different lengths adjacent the other end of the work from the end engaged with the guide or abutment 26. This provides for transverse adjustment of the saw 27 and shaper 29R to cut webs of different length and round their ends.

Figure 9:
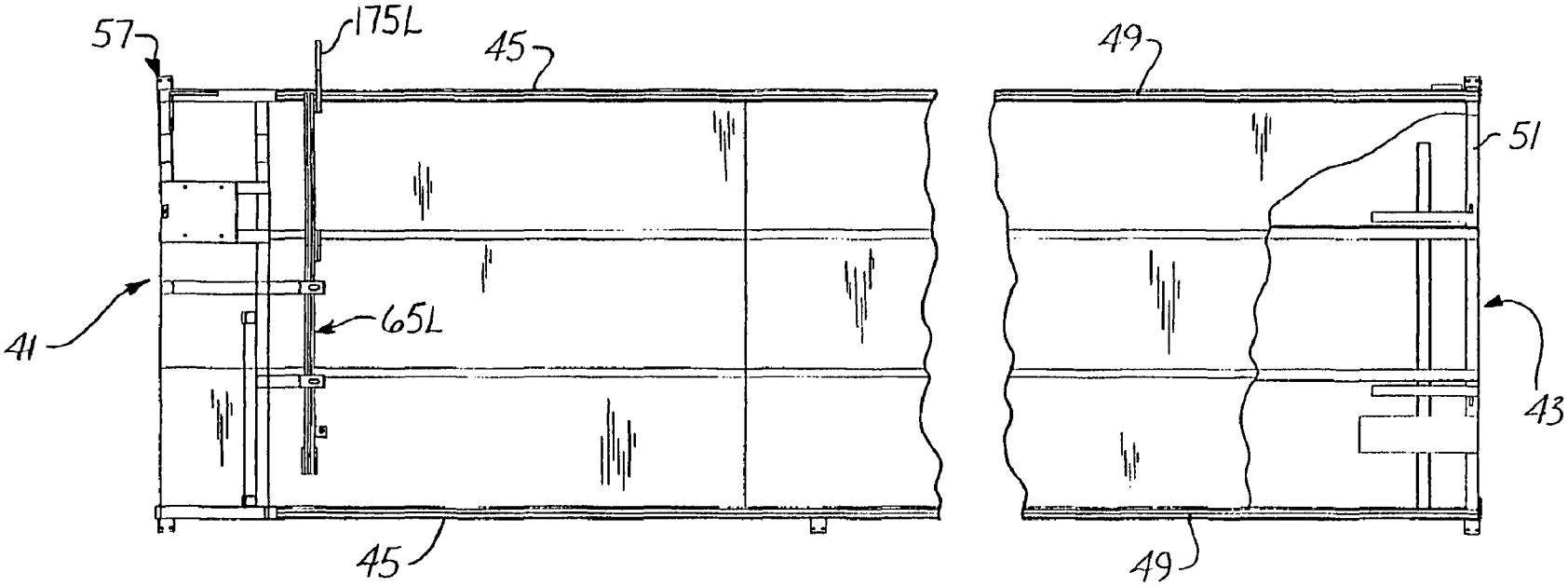
FIG. 9 is a semi-diagrammatic plan, broken away in part, of the frame.
Figure 10:
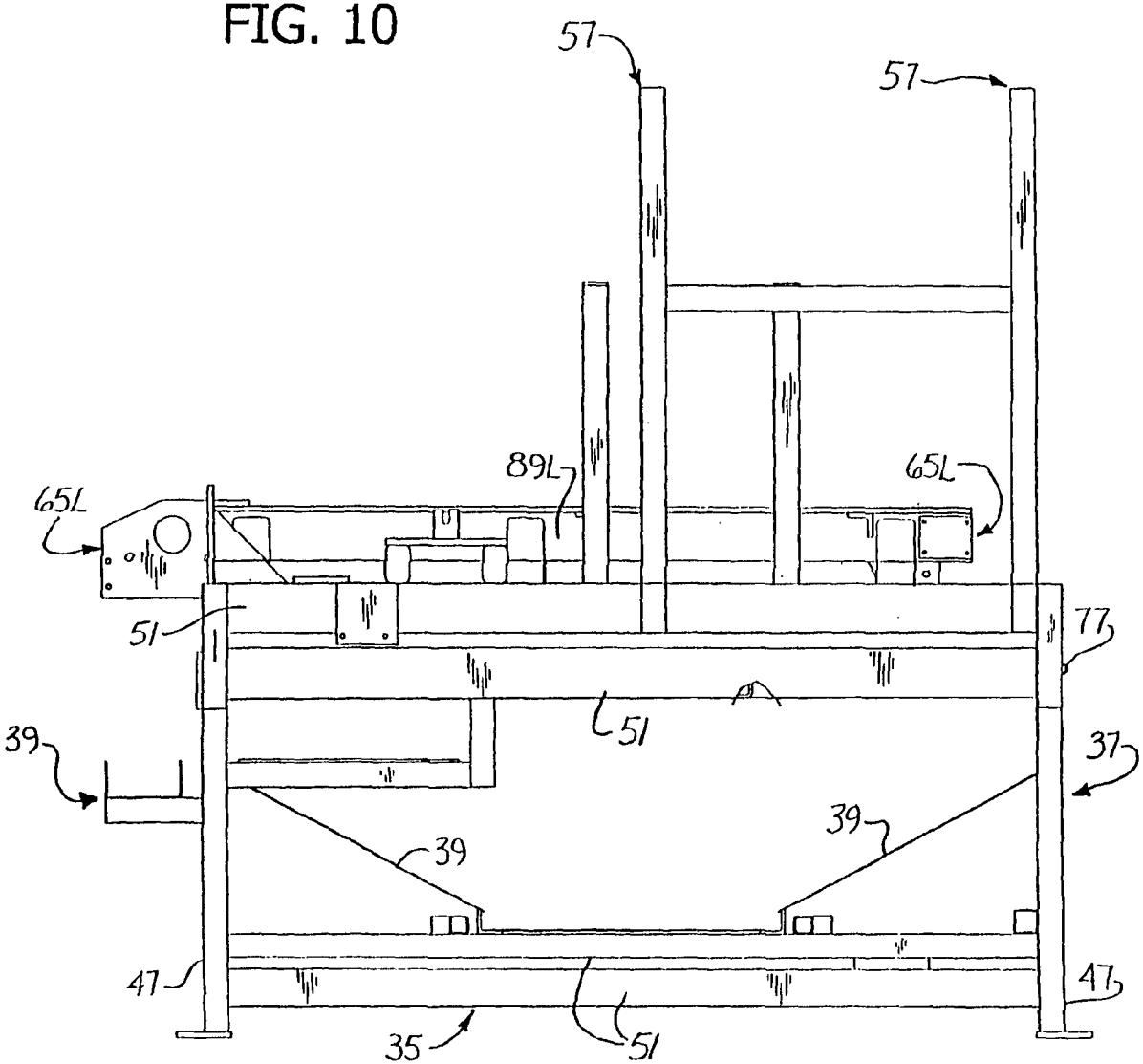
FIG. 10 is a semi-diagrammatic view in elevation of the frame as seen from the left of FIGS. 8 and 9.
Figure 11:
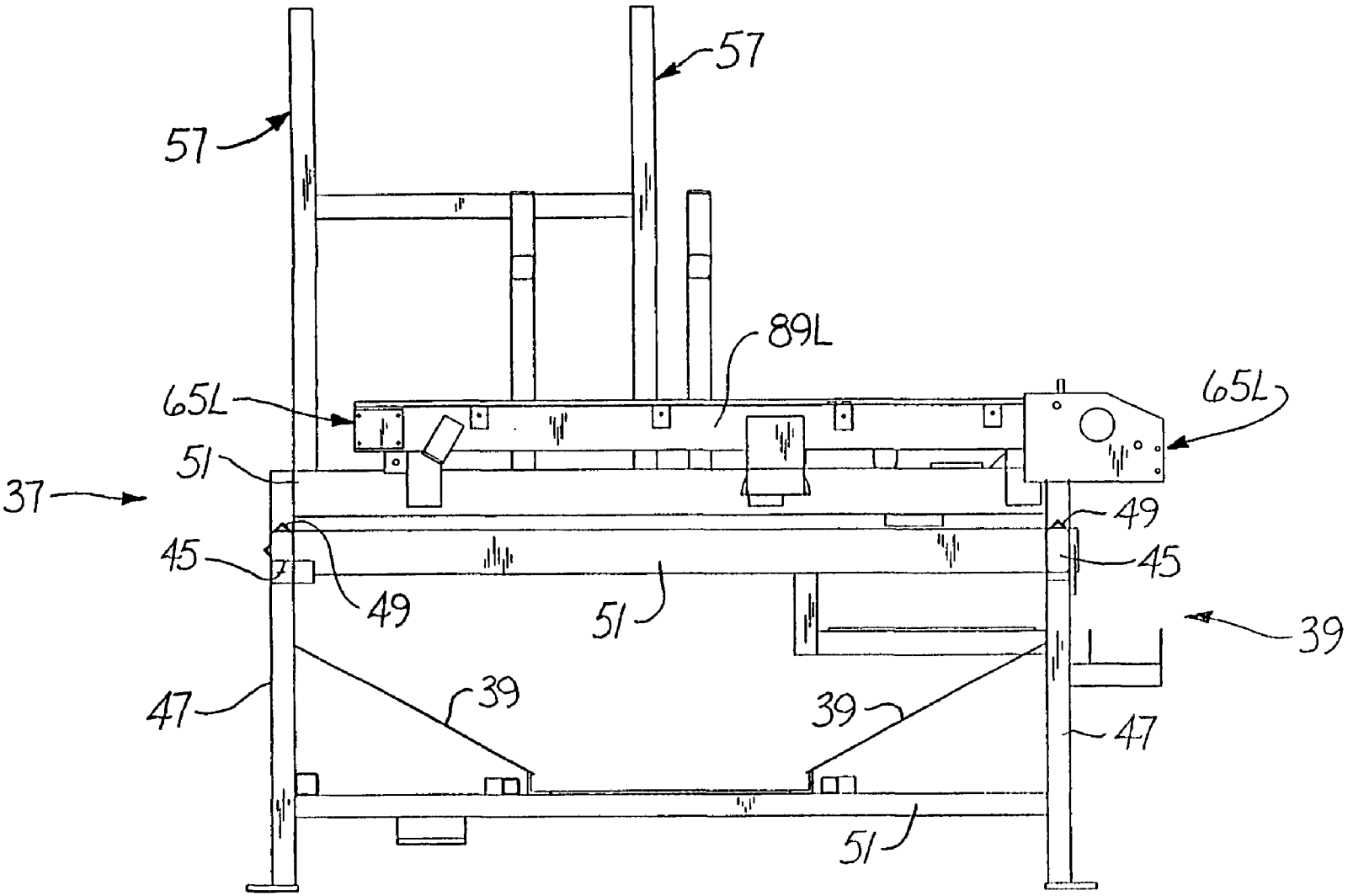
FIG. 11 is a semi-diagrammatic view in elevation of the frame as seen from the right of FIGS. 8 and 9.
Figure 13:
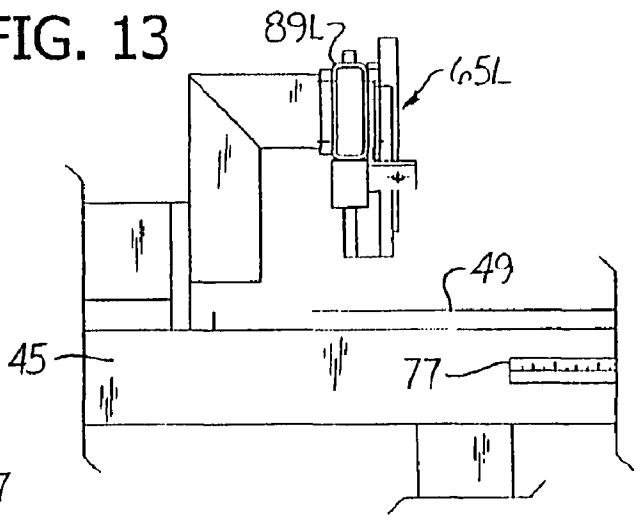
FIGS. 12–19 are semi-diagrammatic views detailing parts of the frame.
Figure 12:
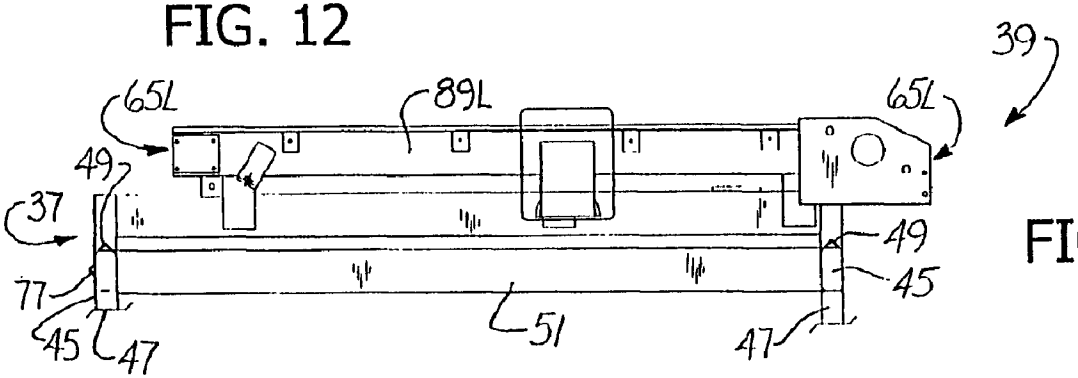
Figure 14:
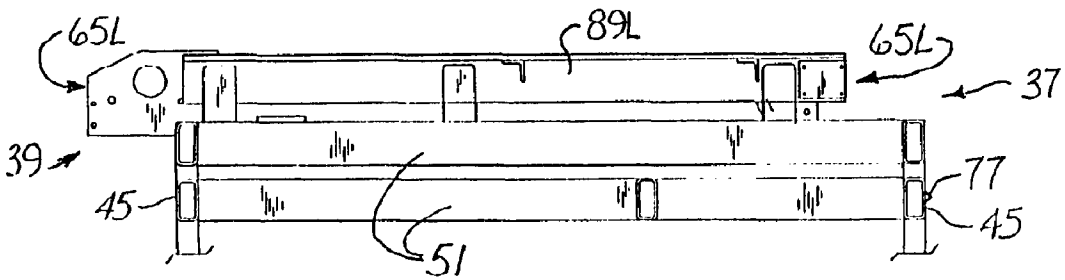

Now referring principally to FIGS. 4–7, apparatus of this invention which carries out the above-described method of the invention is shown to comprise in toto the above-described work feeding system 19 (comprising the conveyors 21L and 21R, 21R being on carrier or carriage 33), the guide or locater plate 26, the shaper 29L, and the saw 27 and shaper 29R on the carriage 33. These components are mounted on an elongate frame 35 having what may be termed a front 37, a back or rear 39, and opposite ends 41 and 43, end 43 being the left end as viewed from the front (and as viewed in FIGS. 4 and 5). The frame 35, which is per se illustrated in FIGS. 9–11 ff., comprises elongate box beams each designated 45 extending from one end to the other at the front and rear on legs 47. Extending lengthwise on top of each beam is a rail 49 constituted by an elongate angle iron seated apex up on the beam. The frame has suitable cross-bars such as indicated at 51 and elongate beams 53 extending from end-to-end below beams 45. Adjacent one end (the left end) the frame has a timber-handling assembly 55, which may be referred to as the fixed timber-handling assembly, comprising the aforesaid conveyor 21L, the left-hand shaper 29L, the guide or abutment 26 and other components to be described. This fixed timber-handling assembly 55 comprises a superstructure 57 on the frame 35 adjacent the left end of the frame as viewed in FIGS. 4 and 5, said superstructure also appearing in FIGS. 8–11 and partly in FIGS. 12–14, where it will be seen to include, among other structural features, an elongate left-hand conveyor support 65L. Mounted on the superstructure is a box 61 for electrical wiring (to be referred to subsequently).

Figure 4:
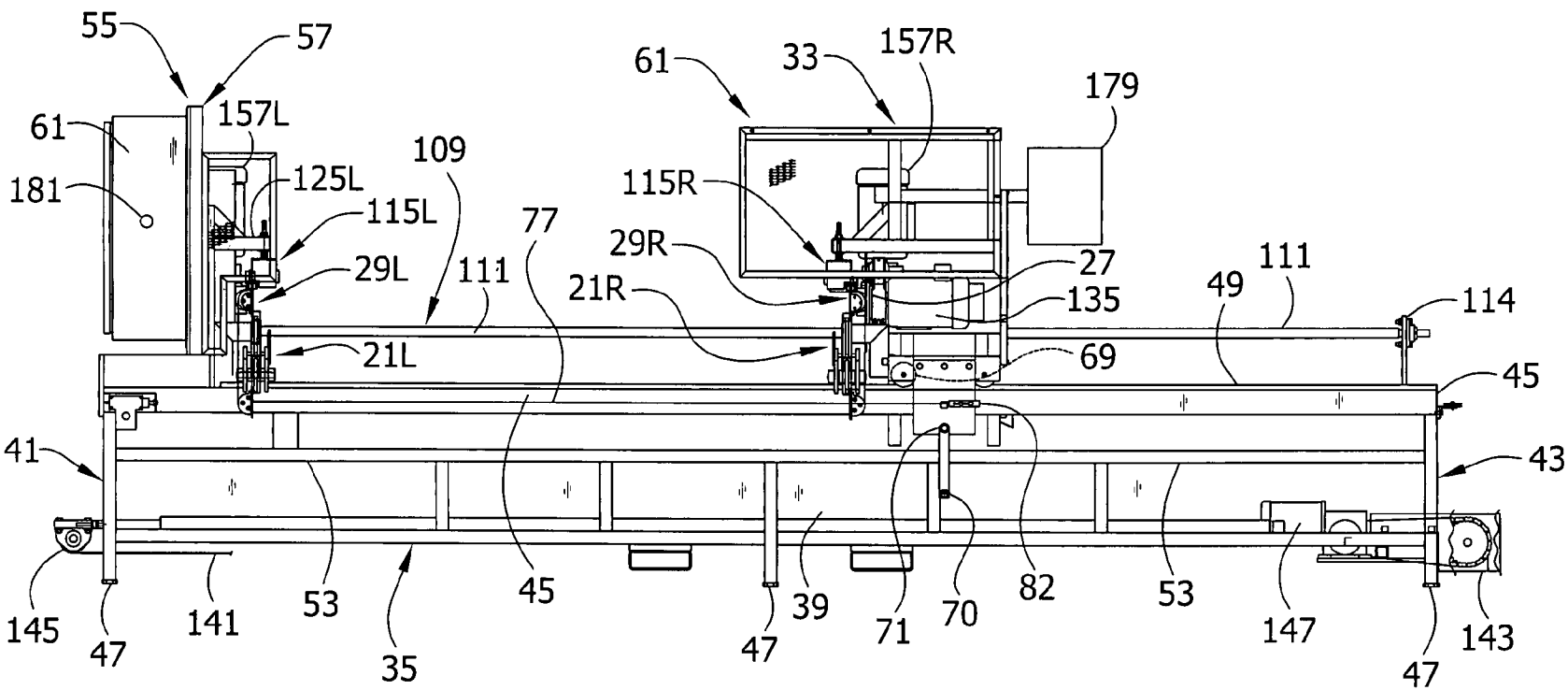
FIG. 4 is a view in elevation of apparatus of the invention as seen from what is termed the front of the apparatus.
Figure 7:
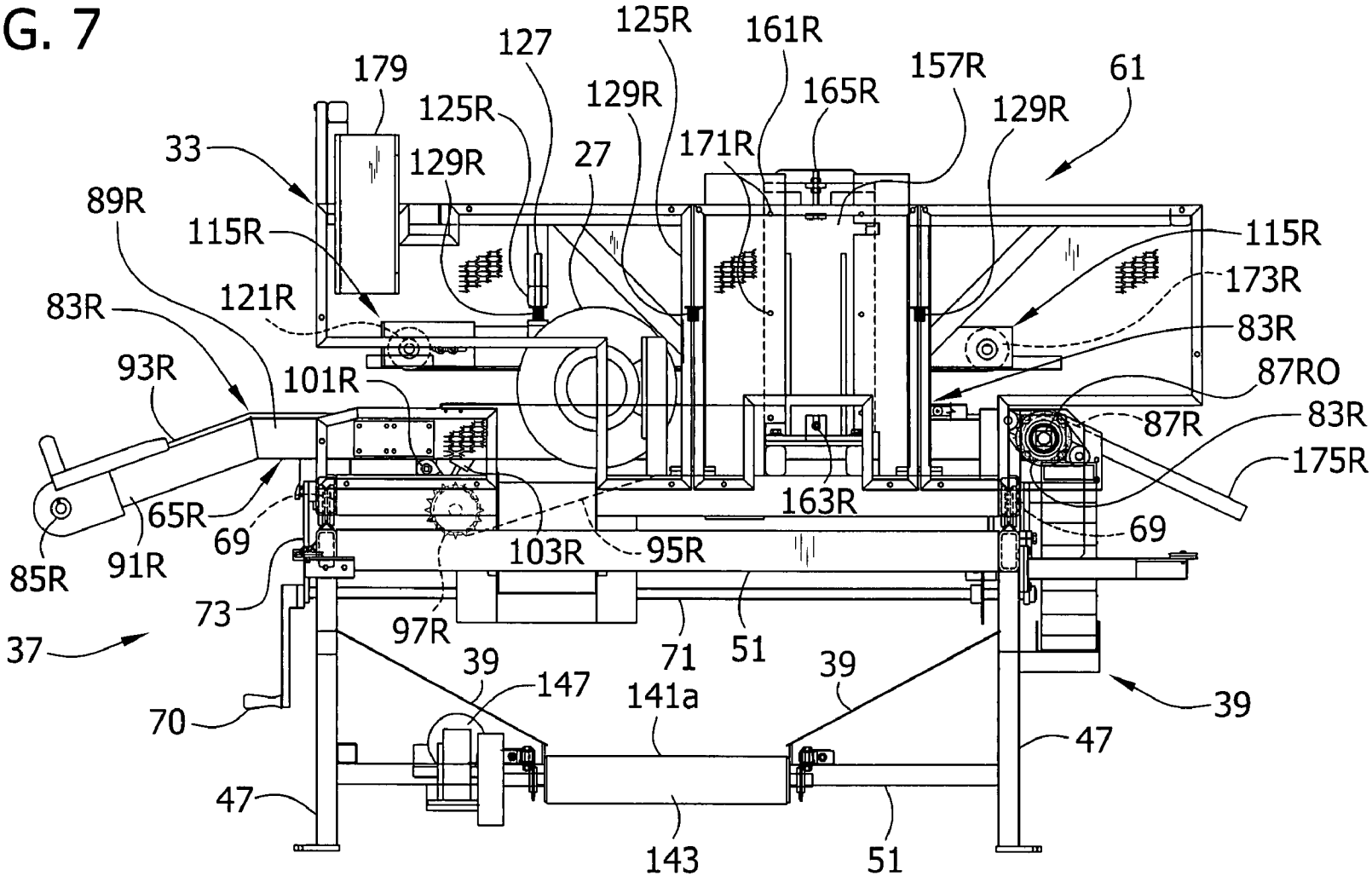
FIG. 7 is a view in elevation of the apparatus as seen from the other end (the right end as viewed in FIGS. 4 and 5), certain parts being shown generally.
Figure 8:
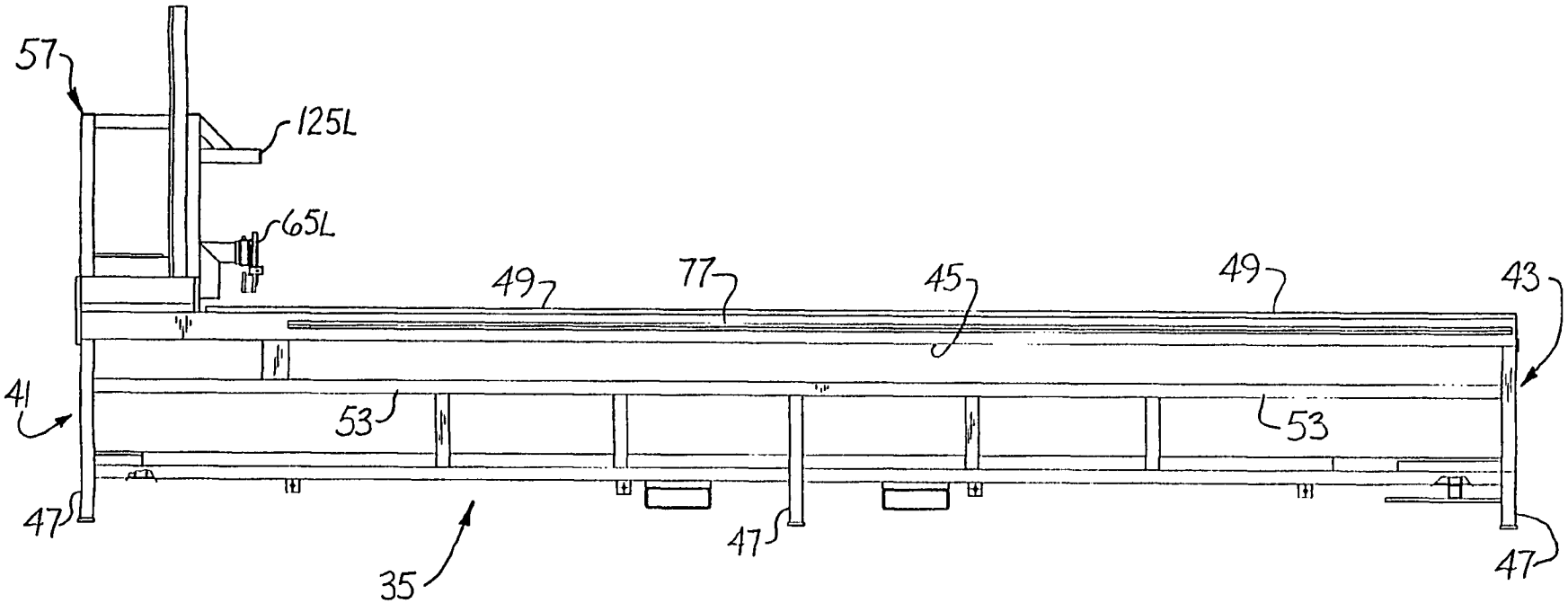
FIG. 8 is generally a semi-diagrammatic front elevation of the frame per se of the apparatus.
Figure 16:
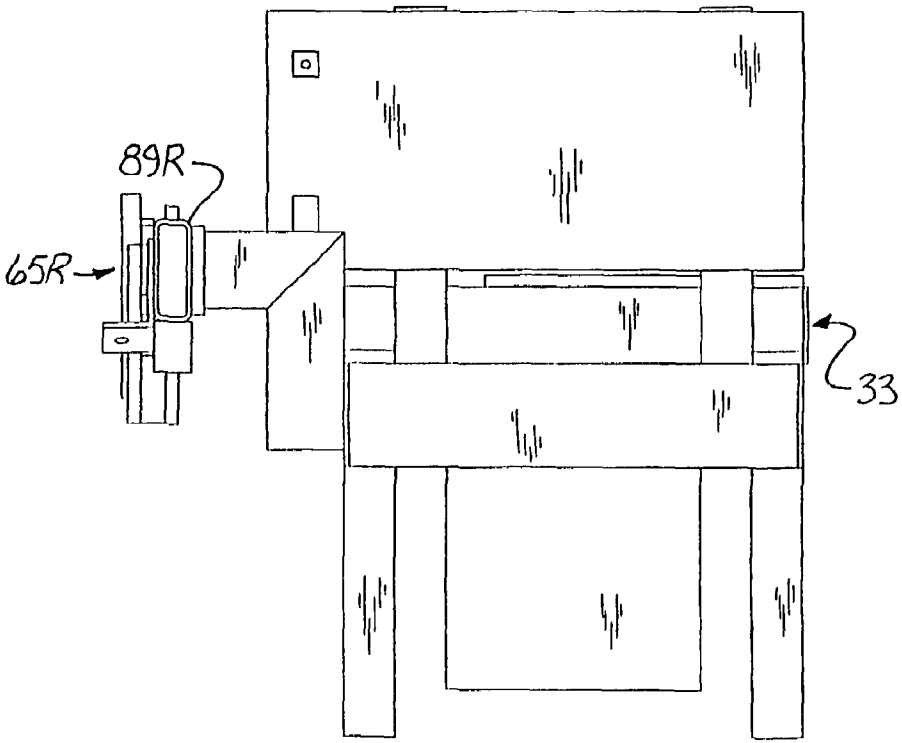
Figure 15:
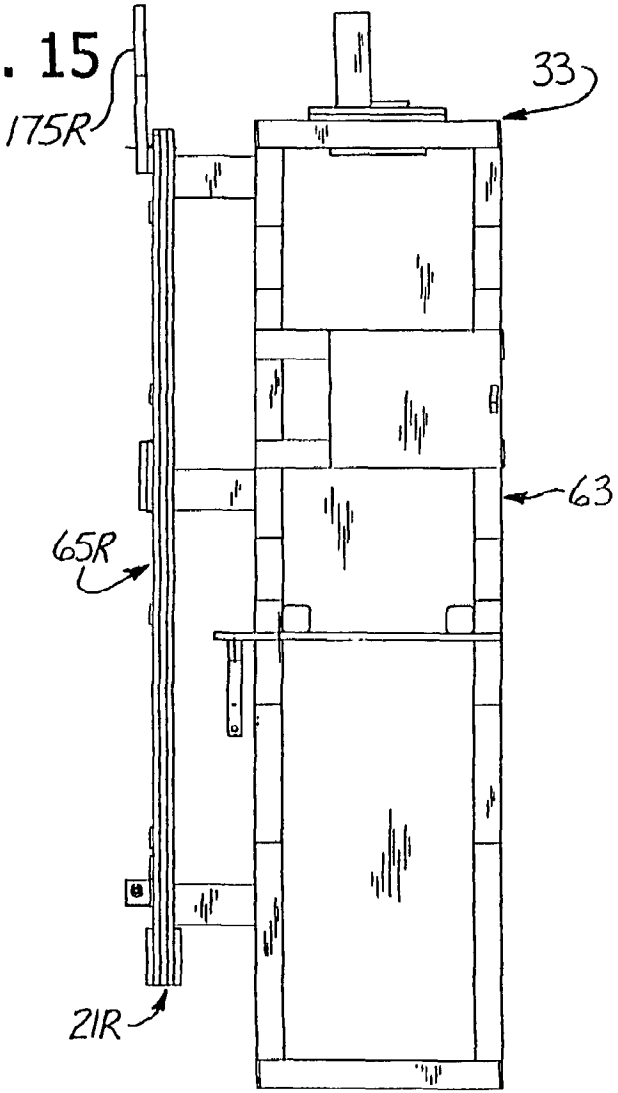
Figure 18:
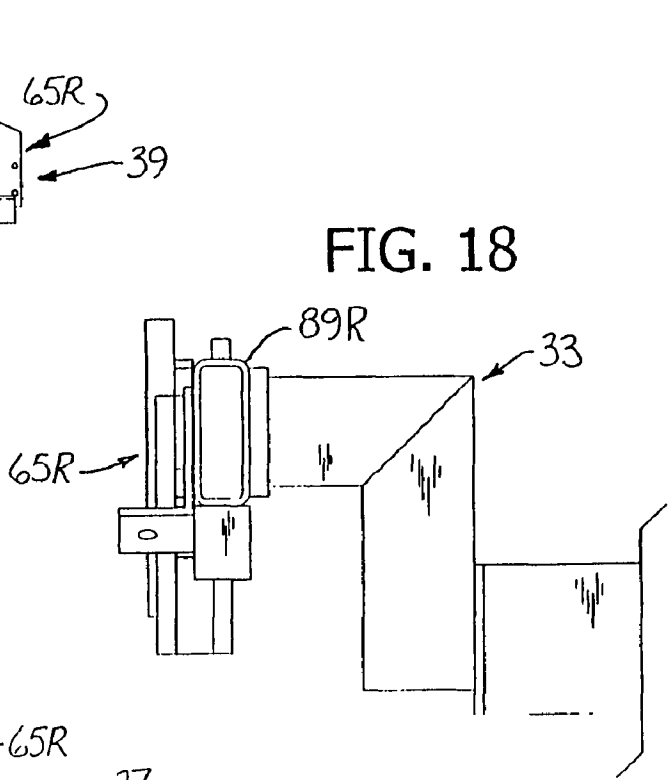
Figure 17:
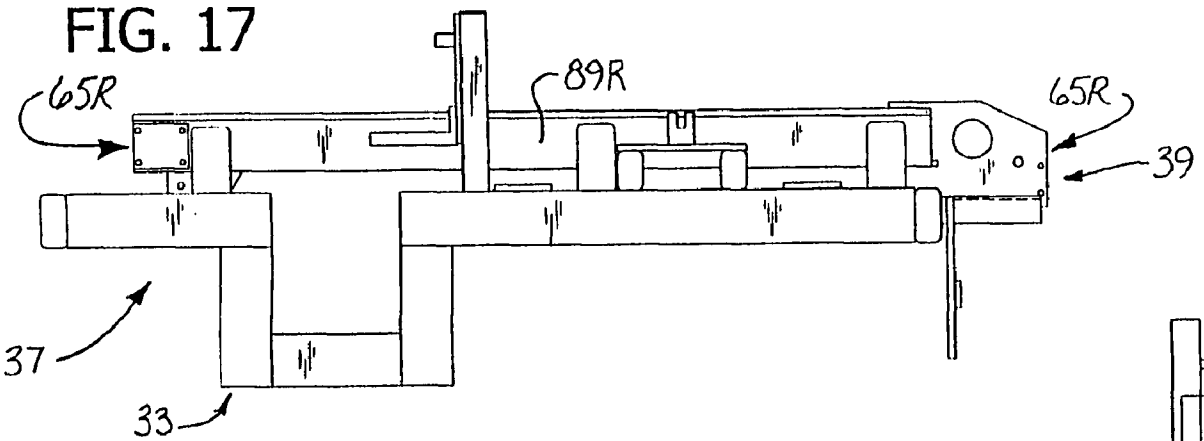
Figure 19:
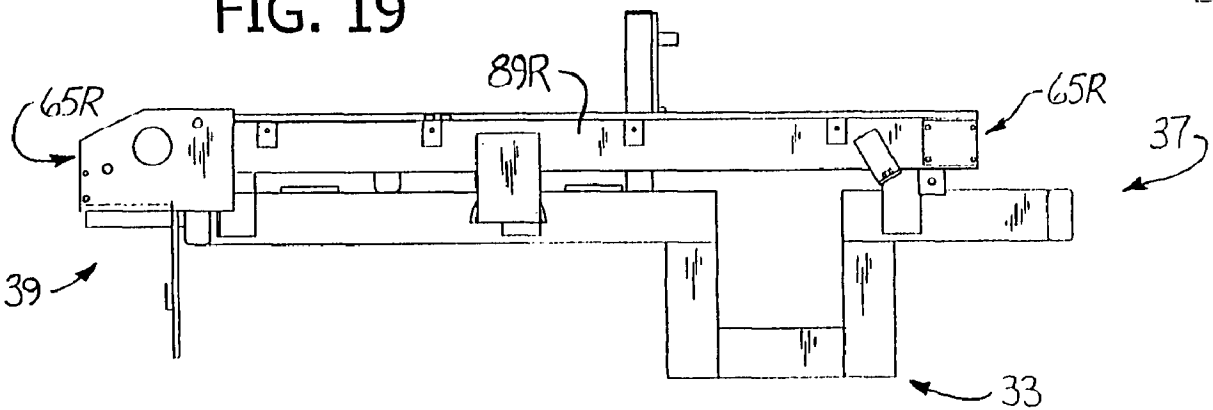
Figure 22:
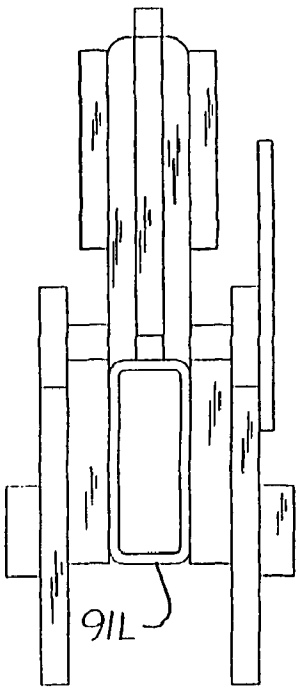
FIG. 22 is a semi-diagrammatic end elevation of the FIG. 21 part on a larger scale than FIG. 21.
Figure 20:
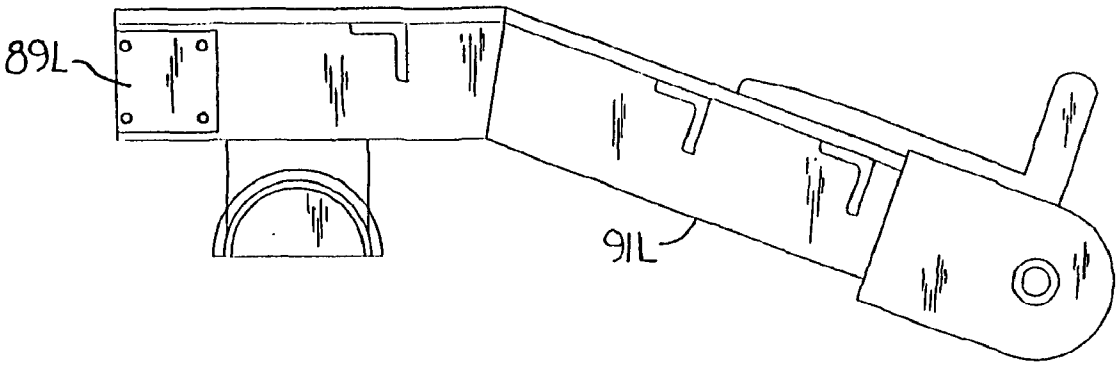
FIG. 20 is a semi-diagrammatic view in side elevation of a part of a conveyor of the apparatus.
Figure 21:
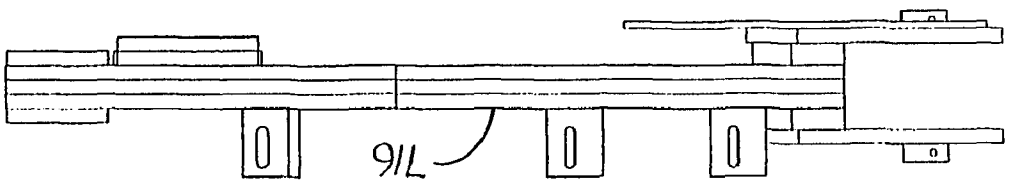
FIG. 21 is a semi-diagrammatic plan of a part of a conveyor.
Figure 25:
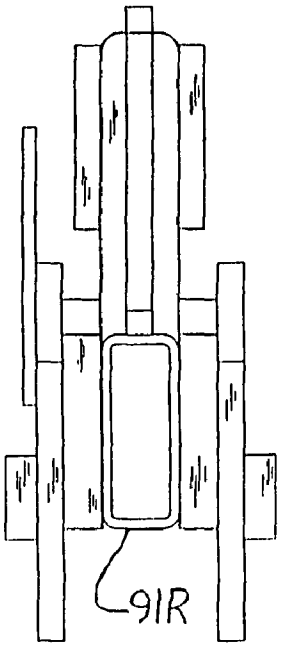
FIG. 25 is a semi-diagrammatic end elevation of the FIG. 24 part on a larger scale than FIG. 24.

The aforesaid carrier or carriage 33, along with the right-hand conveyor 21R, the saw 27, the right-hand shaper 29R and other components to be described carried thereby may be referred to as the movable timber-handling assembly 61, being movable lengthwise (endwise of the frame 35, i.e. left to right and vice versa) toward and away from the fixed timber-handling assembly 55 for cutting timbers (e.g. 2×4's) to different lengths as needed. The carriage 33 comprises a framework, appearing in FIGS. 4 and 7 illustrated per se in FIGS. 15 and 16, parts being shown in FIGS. 17–19, where it will be seen to include, among other structural features, an elongate support 65R for conveyor 21R (the right- hand conveyor) and rail 25R.

The carriage 33 has grooved wheels 69 rolling on the rails 49 (tracks). It is movable toward and away from the fixed timber-handling mechanism 55 by manual operation of a crank 70 at the front end of a cross-shaft 71 geared as indicated at 73 and 75 at its front and rear ends to two of the wheels 69. Extending lengthwise on the front box beam 45 is a length gauge or scale 77 bearing feet and inch markings (e.g. a tape), the carriage 33 having an index 81 as shown diagrammatically in FIG. 3 correlated with the saw 27 readable in conjunction with the scale for setting the distance of the saw from the guide or abutment (locater plate) 26 to equal the length to which the timbers 17 are to be cut. Means for locking the carriage in whatever position it may be set in is indicated at 82.

Figure 23:
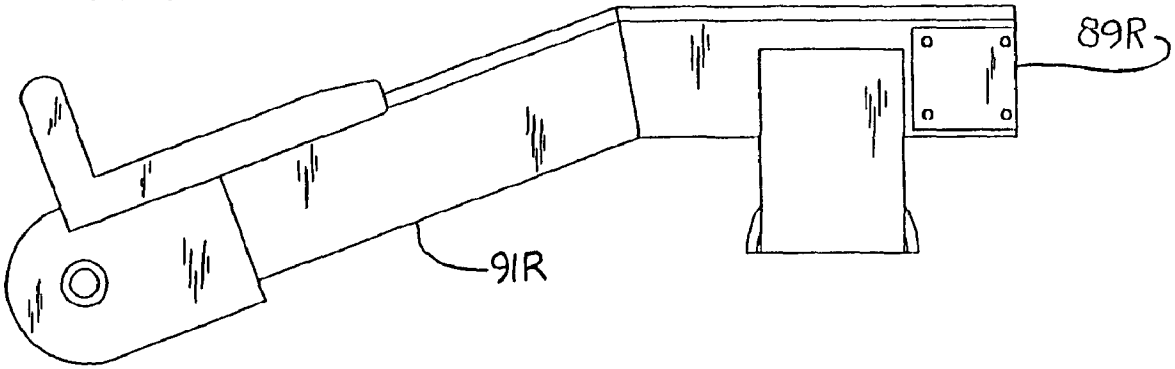
FIG. 23 is a semi-diagrammatic view in side elevation of a part of another conveyor of the apparatus.
Figure 24:
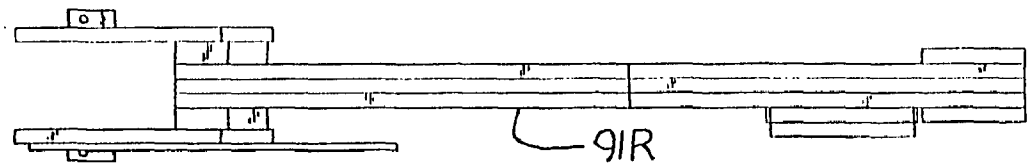
FIG. 24 is a semi-diagrammatic plan of the FIG. 23 part.
Figure 26:
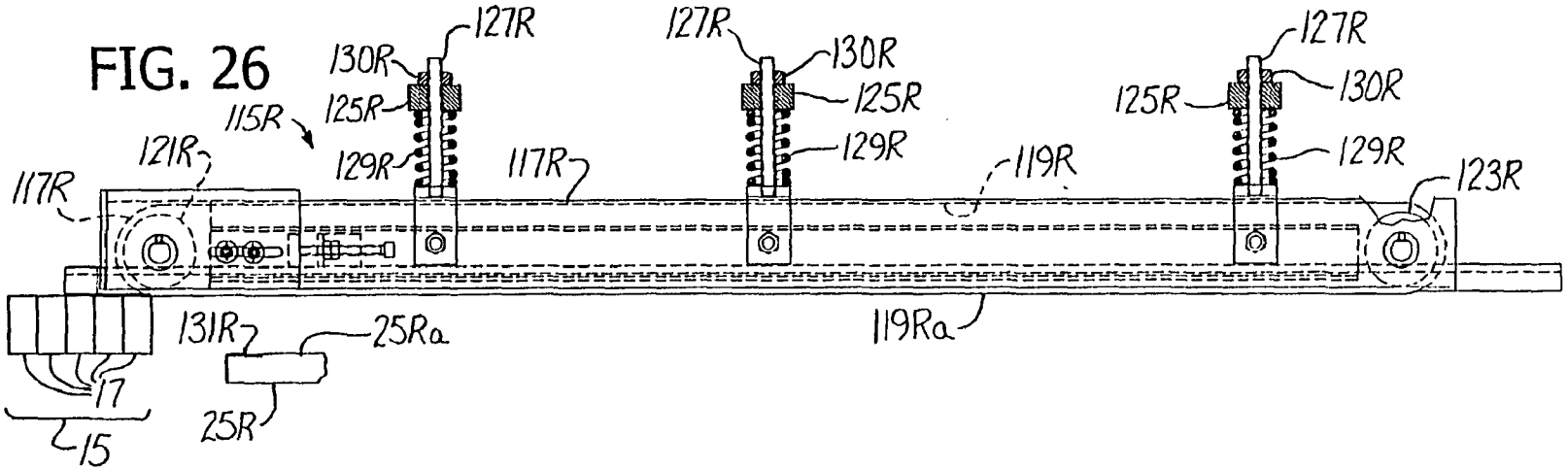
FIG. 26 is a semi-diagrammatic view in elevation of a "hold-down" (per se) of the apparatus, illustrating generally in phantom work approaching the "hold-down", a rail therebelow, and certain associated features.
Figure 27:
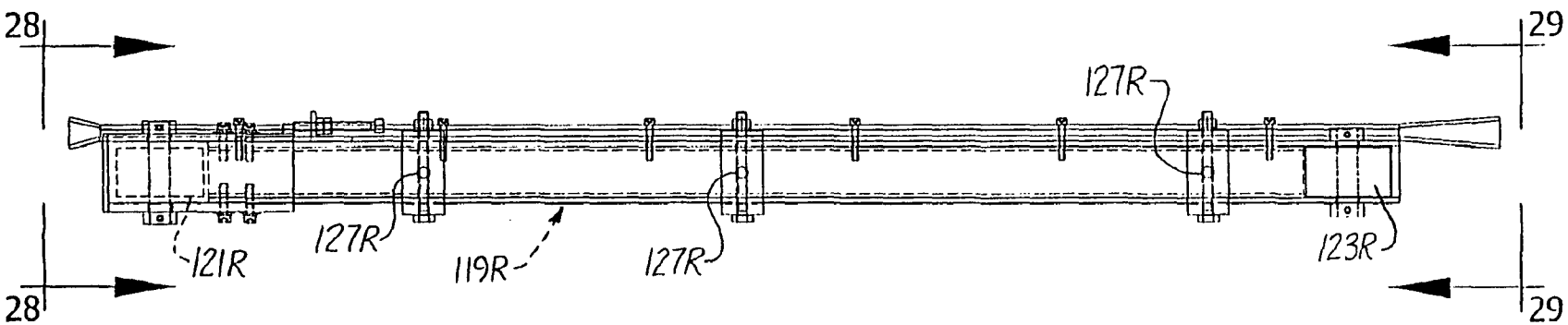
FIG. 27 is a semi-diagrammatic plan of the FIG. 26 hold-down.
Figure 29:
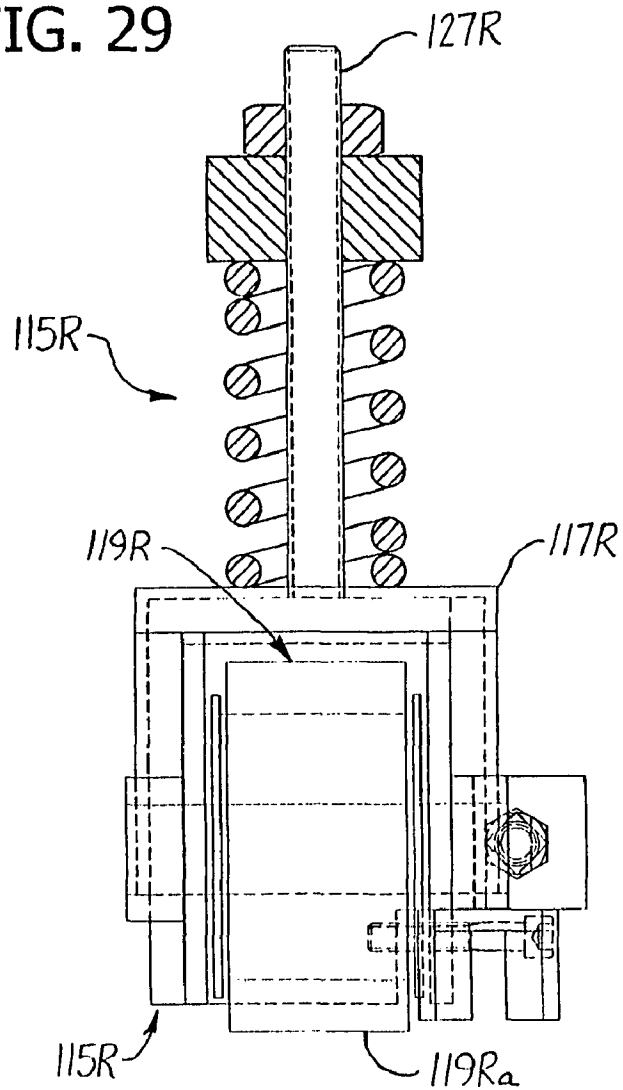
FIGS. 28 and 29 are semi-diagrammatic front and rear end elevations of FIG. 26 on a much larger scale.
Figure 28:
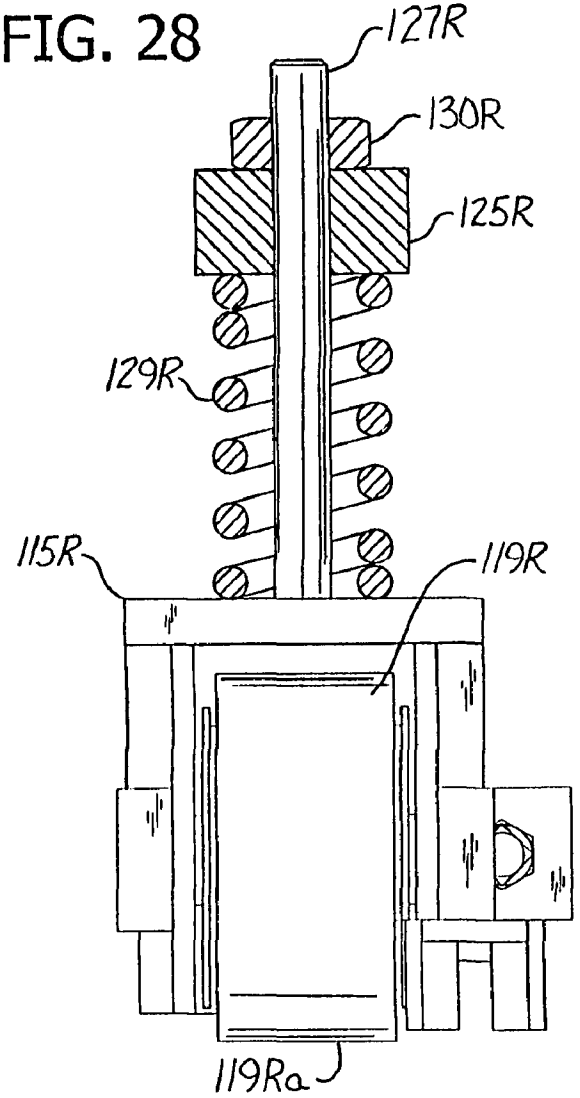
Figure 31:
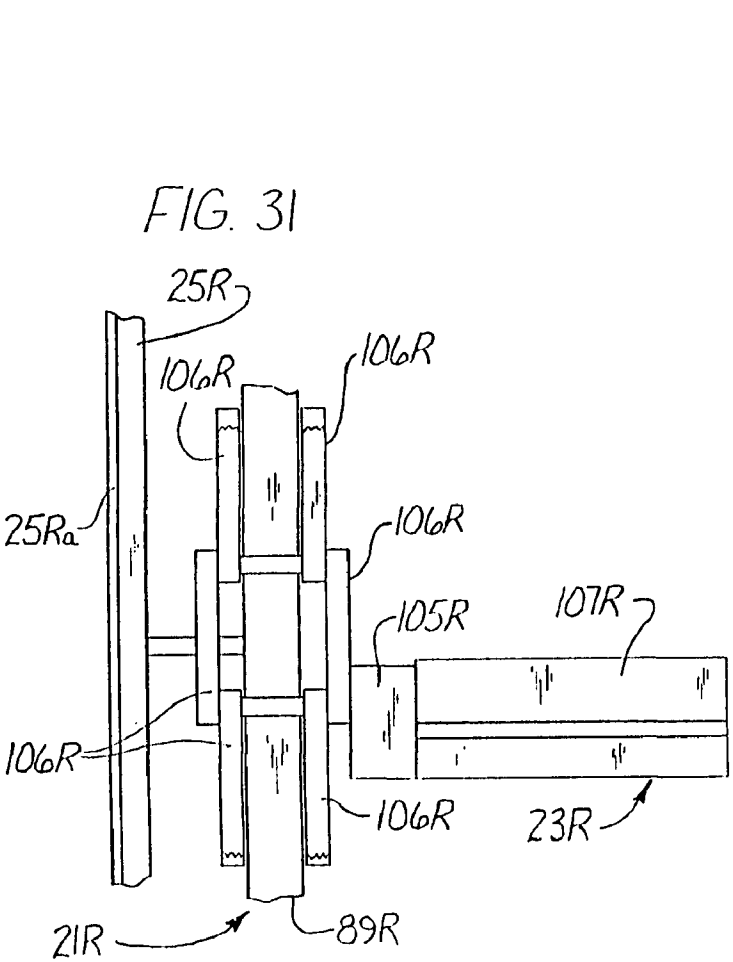
FIG. 31 is a view in plan of FIG. 30.
Figure 30:
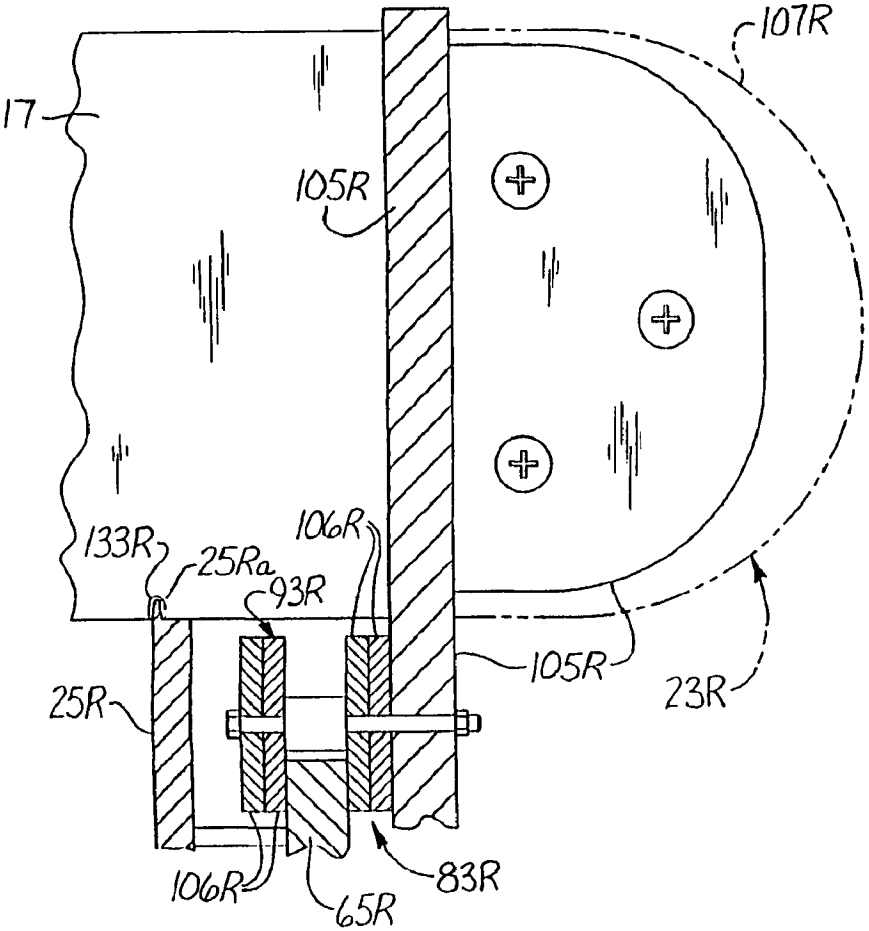
FIG. 30 is a vertical section detailing a conveyor of the apparatus.
Figure 32:
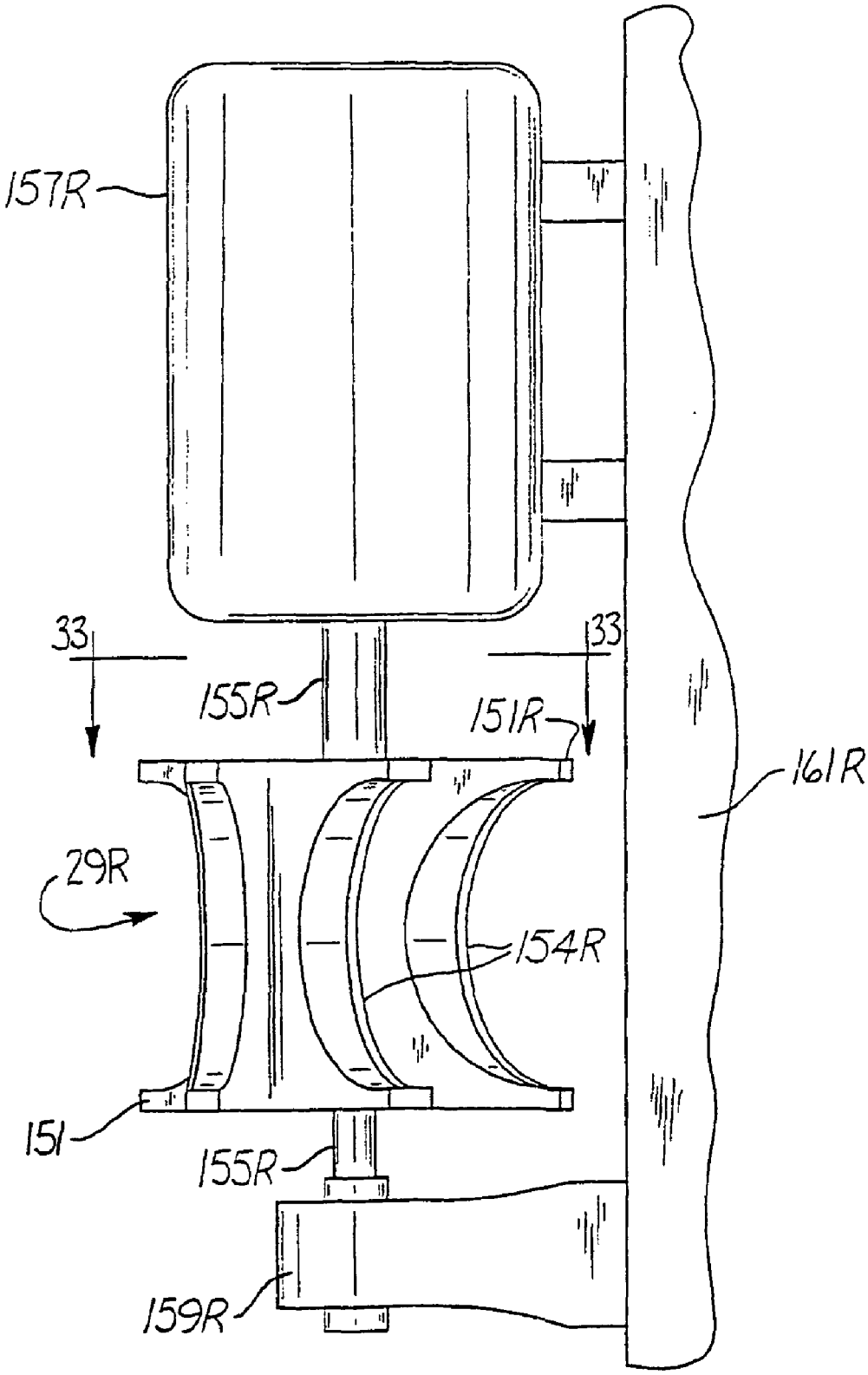
FIG. 32 is a semi-diagrammatic view in elevation showing a shaper and the motor driving the shaper.

The conveyors 21L and 21R are basically similar. Referring principally to FIGS. 7, 30 and 31, the conveyor 21R is shown to comprise an endless chain 83R trained around sprockets 85R and 87R at the front and rear of the elongate support 65R on carriage 33. The support 65R is constituted by a horizontal beam 89R mounted on the carriage extending in front-to-rear direction having downwardly slanting forward extension 91R (see FIGS. 7, 23 and 24) which may be termed the right-hand infeed extension. Sprocket 85R is journalled at the end of extension 91R; sprocket 87R is journalled at the rearward end of the horizontal beam 89R. The chain has an upper reach 93R adapted to travel in rearward direction from sprocket 85R up infeed extension 91R and thence generally horizontally over beam 89R to sprocket 87R, a lower return reach of the chain below the support 65R being designated 95R. The chain is maintained tensioned with its upper reach 93R slidable over the top surface of the support 65R by having its lower return reach 95R engaged by a sprocket 97R on an arm 99R pivoted at 101R on the frame 35 biased as indicated at 103R to effect the tensioning of the chain.

The chain 83R has pushers 23R affixed on the outside (the right side) thereof spaced at intervals for accommodation of work consisting, for example, of five 2×4s organized with their broad (4"-) sides in engagement, between two successive pushers. Each pusher comprises an arm 105R fastened to chain links 106R having a pad 107R made of wood or equivalent artificial material for engaging the work, the pads being replaceably fastened on the arms to take care of the possibility of them becoming damaged in prolonged operation of the apparatus and requiring replacement (which may be effected quickly at low cost). The conveyor 21L corresponds essentially to conveyor 21R, corresponding parts thereof being assigned the same reference numbers as parts of conveyor 21R with the letter L (e.g. support 65L, chain 83L (not completely shown in FIG. 6), sprockets 85L and 87L, pushers 23L etc.), a major difference, of course, being that where conveyor 21R is movable endwise of frame 35 with carriage 33, conveyor 21L is not movable endwise of frame 35. Pushers 23L (each comprising a pad 107L) are affixed on the outside (the left side) of chain 83L. The locater plate 26 is mounted in the superstructure just outside (to the left) of the pushers 23L.

A drive for both the chains 83R, 83L of the conveyors 21R, 21L, indicated in its entirety by the reference numeral 109 (FIG. 5), is shown to comprise a single long shaft 111 of non-round, (e.g. square) cross-section extending from adjacent the left to the right end of the frame 35 through corresponding non-round central openings such as indicated at 87RO and 87LO in sprockets 87R and 87L, the drive further comprising an electric motor 113 with speed reduction at the left end of the apparatus for driving the shaft in clockwise direction as viewed in FIG. 7 to rotate sprockets 87R and 87L in the direction for effecting the travel in front-to-rear direction of the upper reaches of the chains 83R, 83L. Each one of the pushers 23R is aligned (paired with) with a respective pusher 23L in the end-to-end (left-right) direction of the frame, the pairs of pushers being spaced such a distance as to accommodate work items (e.g. five timbers 17) between pairs. The shaft 111 is journalled in bearings as indicated at 114.

Mounted for vertical movement on carriage 33 extending lengthwise in front-to-rear direction at a level above the beam 89R and rail 65R of conveyor 21R is what is termed a "hold-down" generally designated 115R for pressing down on work being pushed rearward and sliding on the rail 25R to hold the work down on the rail. As best shown in FIGS. 26–29, the hold-down comprises an elongate header 117R extending in front-to-rear direction having an endless belt 119R trained around pulleys 121R and 123R mounted for rotation on horizontal axes at the forward and rearward ends of the header. The belt, which is freely movable, has a lower reach 119Ra engageable with the work (and movable rearward by the work as the work moves rearward). Extending up from the header 117R vertically slidable in openings in cantilevered bracket components 125R of the carriage 33 are guide rods 127R. Coil compression springs 129R surround the rods, reacting from the brackets 125R on the header to bias it downward for the engagement of the lower reach of the belt 119R with the work for holding it down on the rail 65R. Downward movement of the hold-down is limited by nuts 130R on the rods.

The conveyor 21L has a similar hold-down (omitted from FIG. 6) for pressing down on the work being pushed rearward sliding on the rail 25L. This left-hand hold-down (identified as 115L) corresponds essentially to the right-hand hold-down 115R, corresponding parts thereof being identified by the same reference numbers as parts of hold-down 115R with the letter L (e.g. header 117L, endless belt 119L etc.). Each of the rails 25R, 25L is constituted by an elongate thin strip mounted alongside the respective elongate support 65R, 65L extending parallel thereto in front-to-rear direction in a vertical plane. The top (horizontal) edge 25Ra of the strip is quite narrow for work guidance (as will be explained) and for relatively low frictional impedance to the sliding of the work thereover. At the forward end of each rail 25R, 25L is a timber-grooving blade 131R, 131L for cutting right-and left-hand grooves 133R, 133L in the bottom of each timber, these grooves receiving the narrow (thin) upper edges of the rails 25R, 25L thus holding the timbers against movement sidewise with respect to the path of travel without impeding their forward movement.

Figure 36:
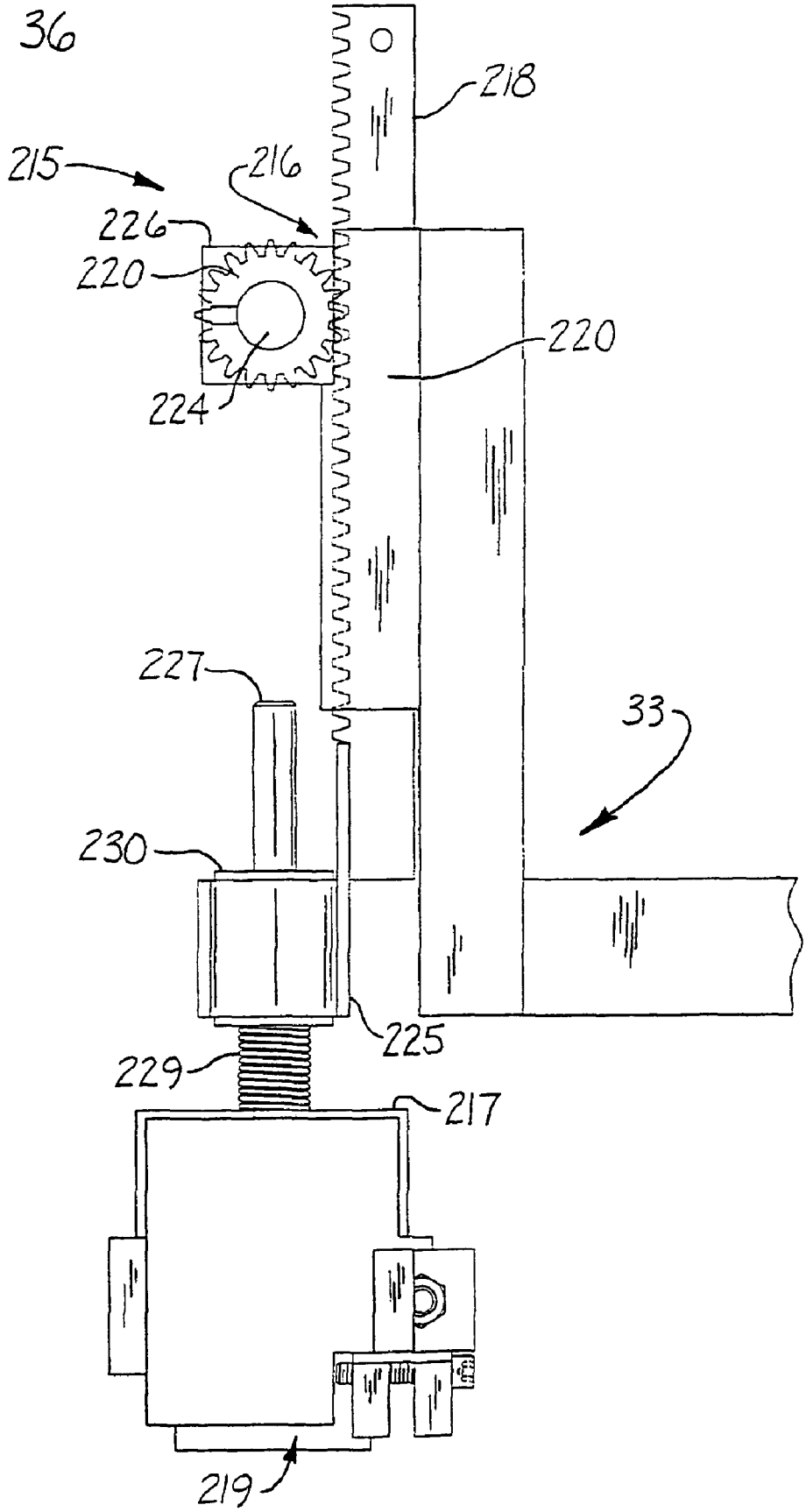
FIG. 36 is an enlarged, fragmentary elevation of a hold-down of another embodiment.

Referring to FIG. 36, a hold-down 215 of a second embodiment is shown. The hold-down 215 is essentially identical to the hold-downs 115R, 115L of the first embodiment. Corresponding parts of the hold-down 215 corresponding to the parts of the hold-downs 115R, 115L are given the same reference numeral, only increased by 100. Each of three spaced apart brackets 225 (only one is shown) is attached to a respective level adjustment mechanism 216 mounted on the carriage 33 for raising and lowering the hold-down 215 relative to the carriage to set the apparatus for particular sized timbers. Each level adjustment mechanism 216 comprises a vertically oriented rack 218 and a pinion gear 220 meshed with the rack. The rack 218 is slidably received in a tube 222 attached as by welding to the carriage 33, and mounts the bracket 225 at its lower end for movement with the rack. The pinion gear 220 is mounted on a horizontal shaft 224 received through a support plate 226 projecting outwardly from the carriage 33 and upper end of the tube 222. All three of the pinion gears 220 are mounted for conjoint rotation with the same shaft 224. The upper end of the tube 222 is open, providing access for the gear 220 to mesh with the rack 218. A crank (not shown) is mounted on one end of the shaft 224 to rotate the pinion gears 220 in a counter-clockwise direction to raise the hold-down 215 and it a clockwise direction to lower the hold-down. The shaft 224 is capable of being locked against rotation for locking the hold-down 215 in a selected position. For example a disk (not shown) mounted on the rack may receive a pin which passes into a tab (not shown) fixed to the carriage 33 to lock the shaft 224 (and hence the hold-down 215) in position.

Figure 5:
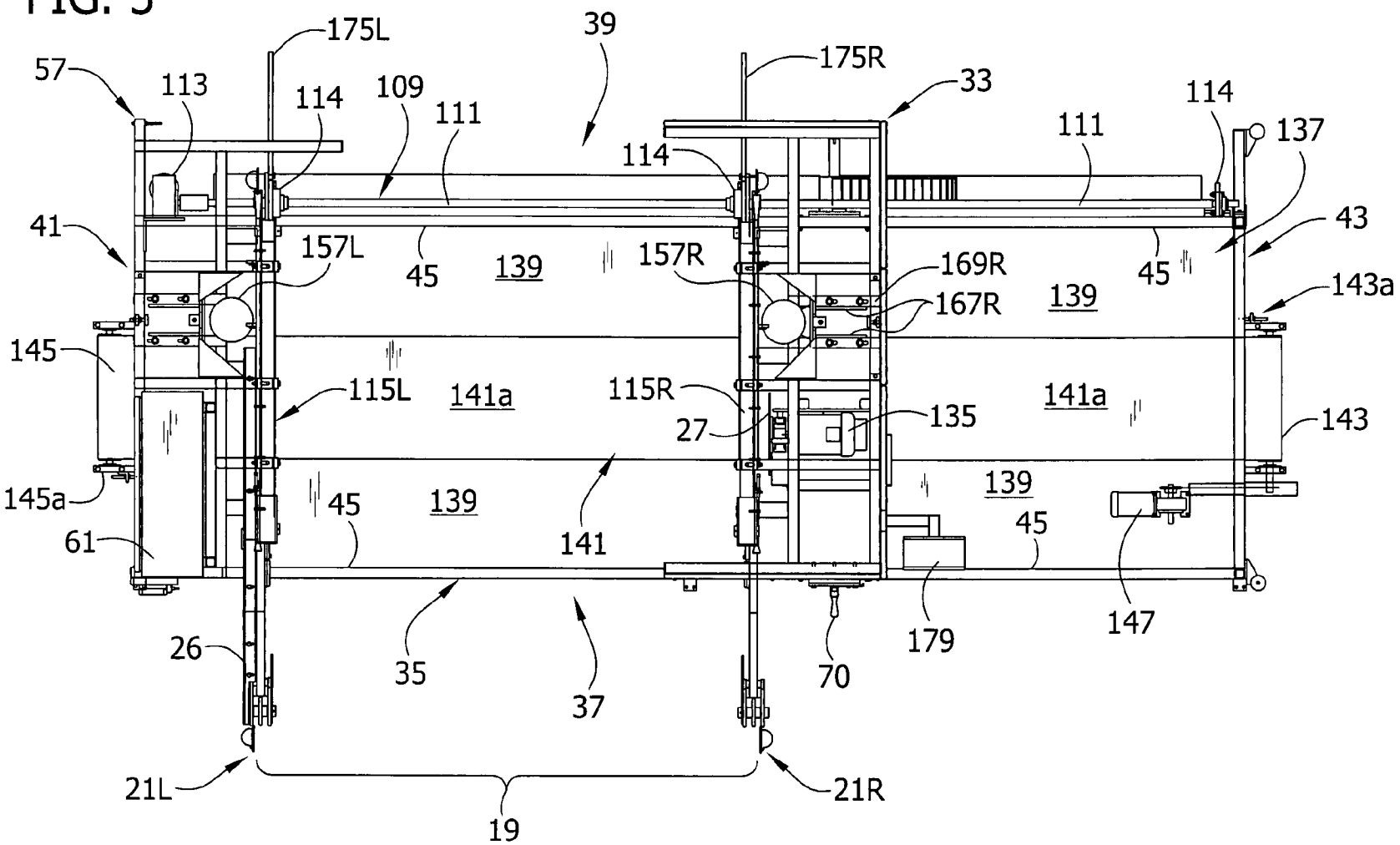
FIG. 5 is a view in plan of the apparatus.

As the work 15 comprising the five 2×4s (grooved as described) is pushed rearward over the rails 25R, 25L by paired pushers 23R, 23L on the chains 83R, 83L, it encounters the saw 27 driven by an electric motor 135 mounted on the carriage 33 (FIG. 5). Thus, right-end portions of the timbers are sawed off, thereby cutting the timbers to the desired length, the sawed-off scrap (and sawdust) falling down into and being carried off to one end (e.g., the left end) of the apparatus by a conveyorized scrap disposal trough generally designated 137. The latter comprises side panels 139 extending generally from end-to-end of the frame 35 underneath the timber-handling assemblies 61 and 55, and an endless belt 141 trained around pulleys 143 and 145 journalled as indicated at 143*a* and 145*a* at the ends of the frame 35 for rotation on horizontal axes extending in front-to-rear direction as regards the frame, the belt having an upper reach 141*a* extending in a generally horizontal plane from one end of the frame 35 to the other bottoming the space between the lower margins of the trough's inclined side panels 139. An electric motor for driving pulley 143 for effecting travel of the upper reach 141*a* of the belt from one end of the frame to the other for carrying off scrap is indicated at 147.

Figure 33:
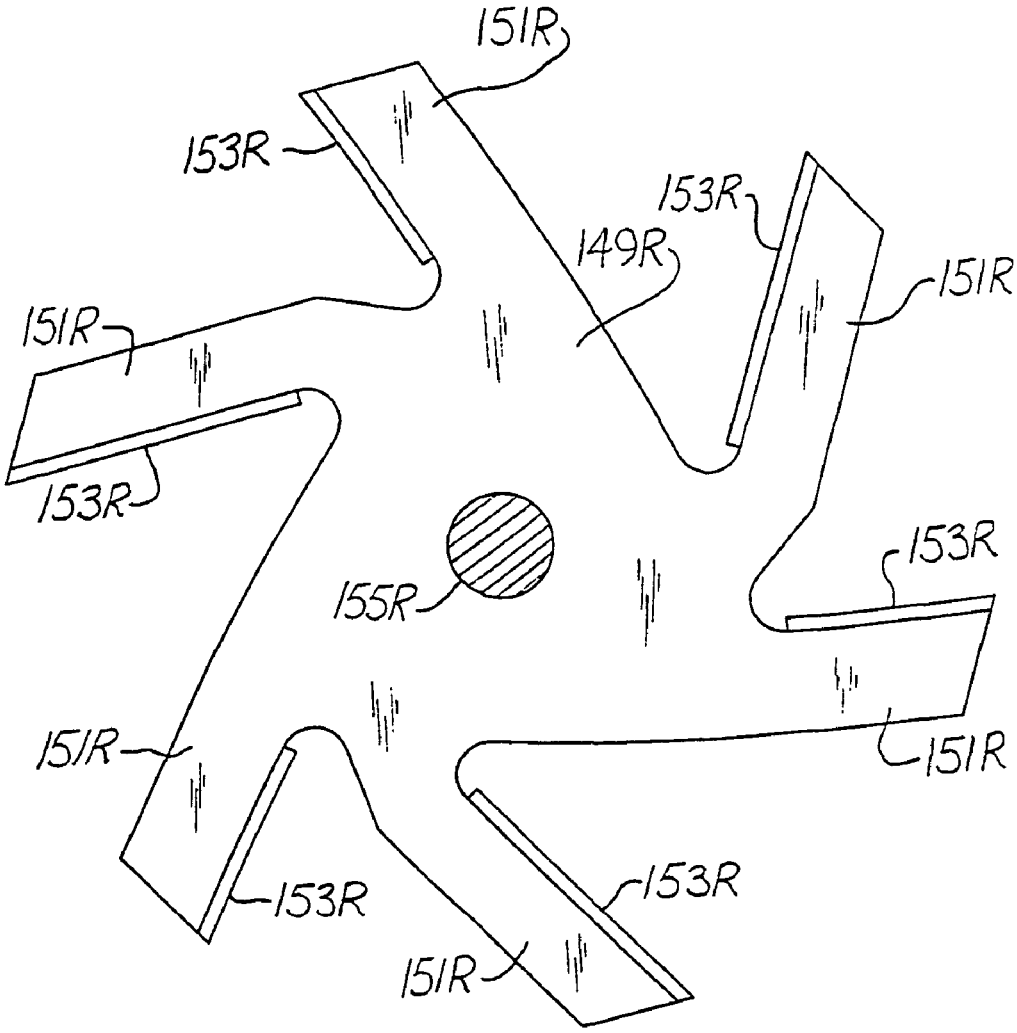
FIG. 33 is an enlarged section taken generally on line 33—33 of FIG. 32.
Figure 34:
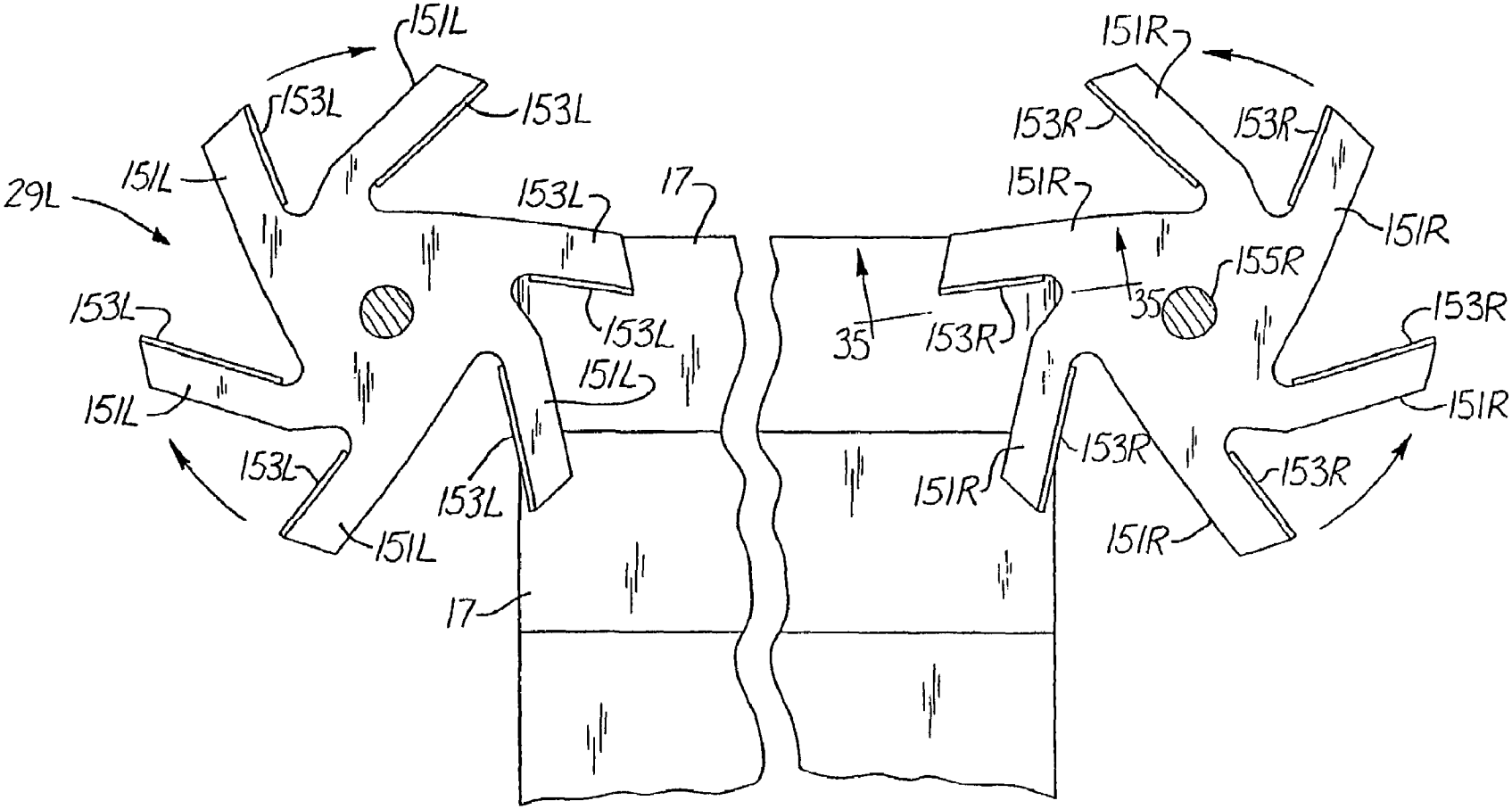
FIG. 34 is an enlarged fragment of FIG. 33.
Figure 35:
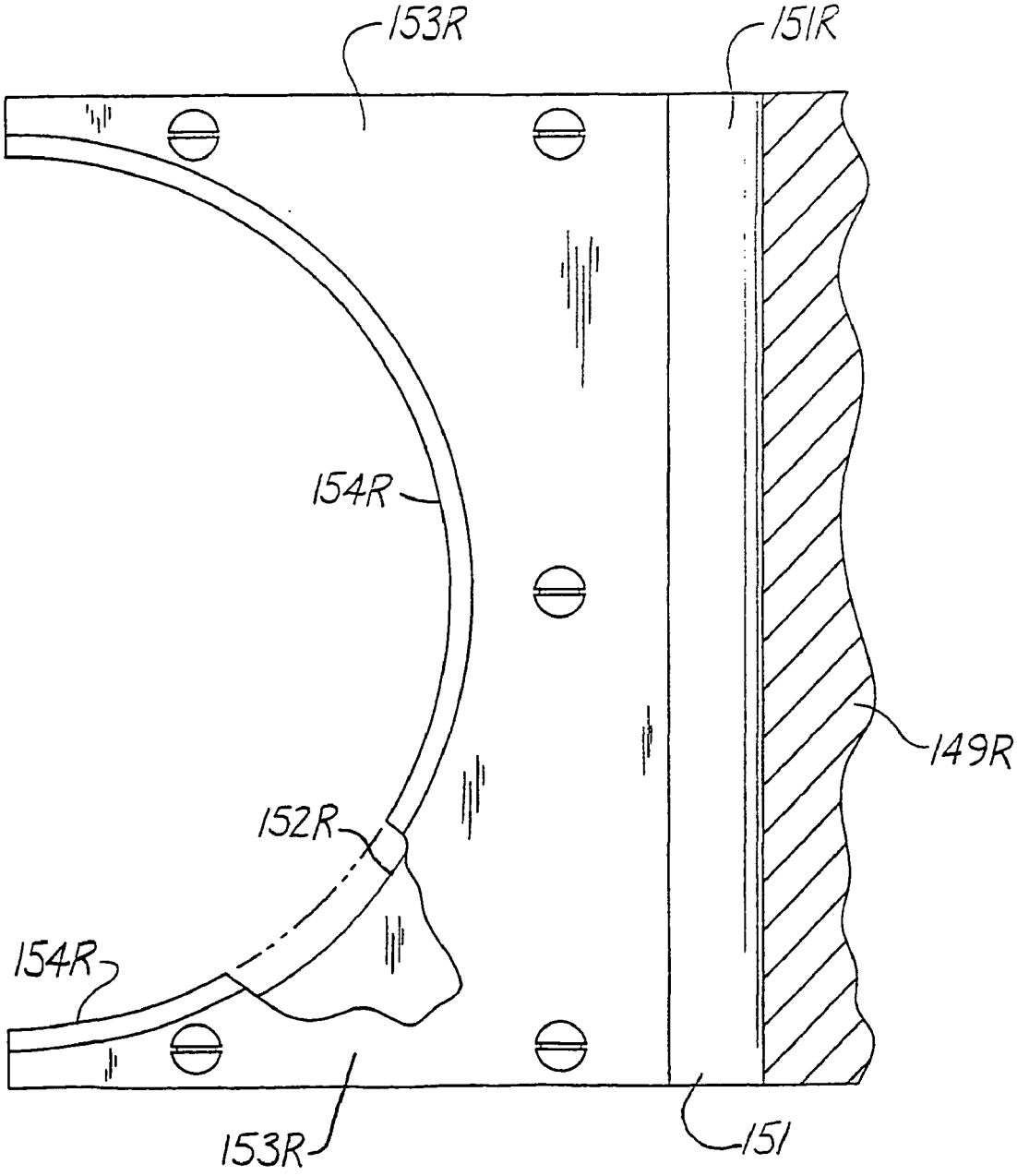
FIG. 35 is a section generally on line 35—35 of FIG. 34.

The shaper or cutter 29R on the carriage 33 for rounding the right-hand ends of timbers 17 as they move forward is a spinner, illustrated particularly in FIG. 33 as comprising a hub 149R with six cutter arms each designated 151R extending outward from the hub in off-radial planes in a generally spiral configuration, each arm having a concave (e.g. semicircular) recess 152R and a carbide blade 153R affixed thereto providing an arcuate cutting edge (e.g. a semicircular concave edge) 154R (see FIG. 35) for the rounded end cutting. The shaper or cutter 29R is keyed on shaft 155R extending down vertically from an electric motor 157R operable to spin the shaper or cutter at relatively high speed (e.g. 3450 rpm) in the direction indicated in FIG. 3. The motor and a bearing 159R for the lower end of the shaft are affixed on a motor/bearing mount 161R adjustable horizontally and vertically with respect to the carriage for setting the shaper in accurate position. The motor/bearing mount 161R is adjustable horizontally by turning a nut on a screw 163R, vertically by turning a nut on a screw 165R, and adapted to be bolted in horizontally adjusted position by bolts 167R extending through slots 169R and in vertically adjusted position by bolts 171R extending through slots 173R (e.g., FIG. 7). In another, and more preferred embodiment (not shown), the cutter has three cutter arms rather than six. It will be appreciated that the number of cutter arms can be different without departing from the scope of the present invention.

The shaper or cutter 29L of the fixed timber-handling assembly 55 and the motor for 29L and mounting thereof correspond essentially to the above-described shaper or cutter 29R, motor 157R and mounting 161R, corresponding parts thereof being assigned the same reference numbers as parts associated with 29R but with the letter L (e.g. motor 157L etc.).

As the five timbers 17 of a five-timber item of work 15 (or whatever other number of timbers constitutes an item of work), having had both ends trimmed by the shapers or cutters, continues its travel due to pushing action of the conveyors 21L, 21R, they slide rearward out of the apparatus on ramps 175R and 175L (FIG. 5) which are inclined downwardly from the rear ends of the conveyors.

Figure 6:
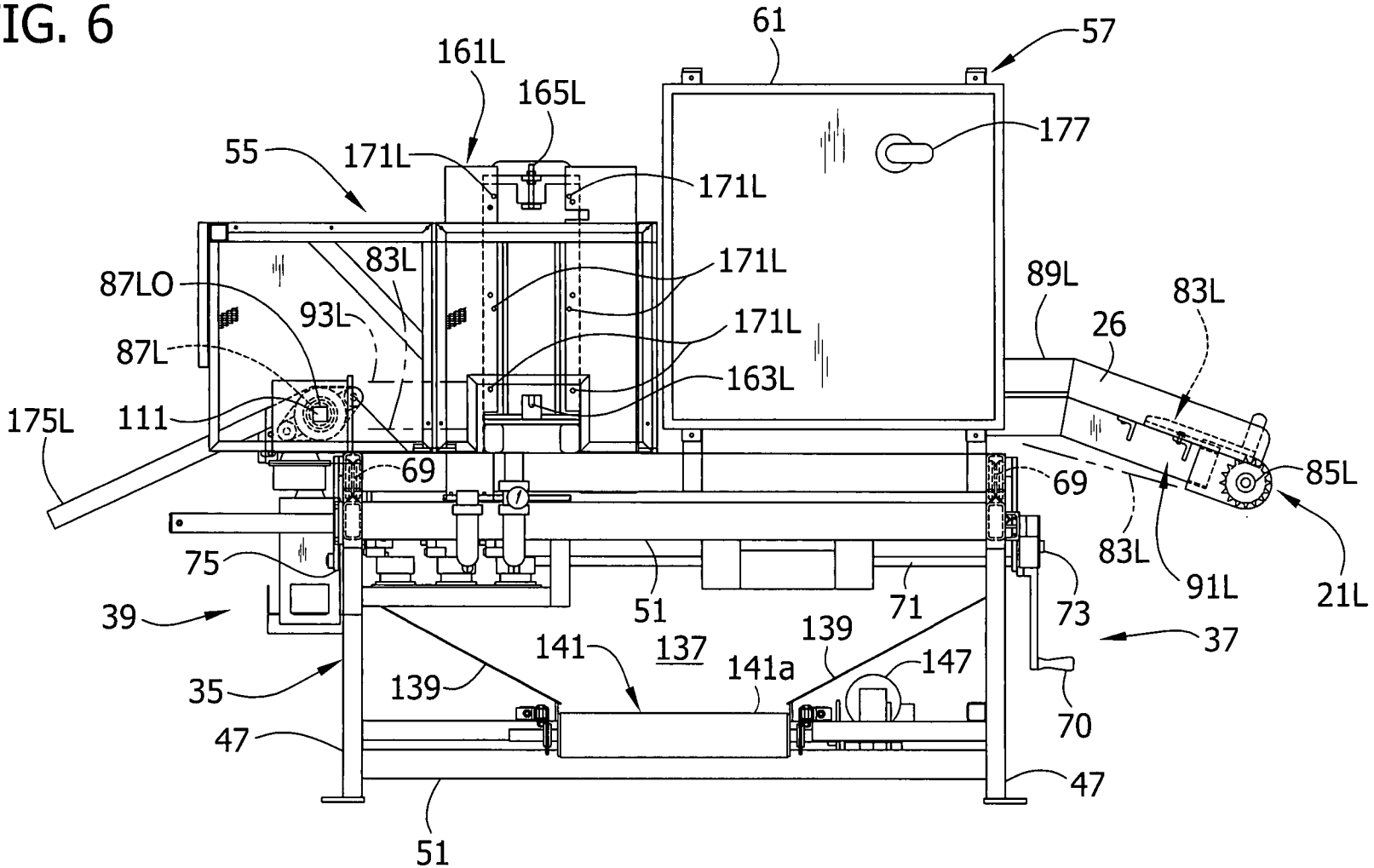
FIG. 6 is a view in elevation of the apparatus as seen from one end thereof (the left end as viewed in FIGS. 4 and 5), certain parts being shown generally.

The box 61 on the framework of the fixed timber handling assembly 55 has electrical wiring (not shown) supplied thereto through an inlet 177 (FIG. 6). Flexible wiring (not shown) in sufficient length to accommodate connection to a control panel 179 on carriage 33 at the front of the apparatus in the setting of the carriage at the extreme right end of the frame 35, extends through a box outlet 181 (FIG. 4) to the control panel. The latter mounts switches (not shown) accessible at the front of the apparatus to an operator of the apparatus for controlling the electric motors, the switches being wired to the motors by wiring (not shown).

Operation of the apparatus is generally as follows:

The carriage 33 (the timber-handling assembly 61) is set in position endwise of the apparatus for sawing by the saw 27 of the timbers 17 constituting the work 15 to selected length for the run desired (e.g. for sawing off end portions of more than 10 feet long 2×4s to 10 feet). This setting is carried out by turning crank 70 to move the carriage endwise of the frame 35 to position it with the saw in the vertical plane e.g. 10 feet from the locater plate 26 as observed by registration of the index 81 with the 10 foot marking on the scale 77, then locking the carriage in the said setting by means of the lock 82. With the carriage 33 set in position, motor 147 is turned on to drive the scrap-removal belt 141 for travel of its upper scrap-carrying reach 141*a* from right to left as viewed in FIGS. 4 and 5.

An item of work 15 (e.g. the five 2×4s 17)is manually loaded between flights of chains 83R, 83L on the inclined infeed portions of chains 83R, 83L on the infeed extensions 91R, 91L of conveyors 21R, 21L, the left ends of the timbers 17 being engaged with (butted against) the locater plate 26 for establishing their 10-foot cut-off location and being organized as shown in FIG. 3 and above described. The downwardly inclined disposition of the inclined portions of the chains on the infeed extensions facilitates the manual loading thereon. Motors 113, 135, 157R and 157L are turned on to (a) drive the conveyor chains 83R, 83L and, (b) drive the saw 27, and (c) drive the cutters or shapers 25R, 25L, the motor 113 coming on to drive the conveyor chains after a brief delay (e.g. a two-second delay). With the conveyor chains in operation, the work 15 (the batch of five 2×4s) is fed forward up the infeed incline, then horizontally for a relatively short distance over the forward reaches of beams 89R, 89L of conveyors 21R, 21L, and onto the horizontal rails 25R, 25L. As it approaches the rails 25R, 25L it comes under lower reaches of the belts of the hold-downs 115R and 115L, which act under the bias of springs 129R, 129L for the pressing down of the work on the rails by the lower reaches 119Ra, 119La of the hold-down belts, these reaches travelling forward as the work moves on. And as the work comes on to the rails 25R, 25L, it is grooved as indicated at 133R, 133L by the grooving blades 131R, 131L, the grooving being more of a pressed or mashed-in variety than a cut. From then on the work is maintained against lateral displacement by the guidance provided by the thin upper edges 130 of the rails 25R, 25L tracking in the grooves, as well as being held down.

As the work 15 continues being pushed toward the rear of the apparatus tracking on rails 25R, 25L by the respective pair of pushers 23R, 23L on the conveyor chains 83R and 83L, it encounters the saw 27 which functions to cut the five timbers 17 constituting the work 15 to the length (e.g. the 10-foot length) according to the carriage setting. Having been cut to length, the work then encounters the shapers or cutters 29R and 29L, spinning at relatively high speed, which function to round both ends of the timbers 17 simultaneously. Finally, the work, now sawed to length and having had its ends rounded, passes off the conveyors 21R, 21L and on to the inclined rear ramps 175R, 175L, down which it slides for being taken away.

When the first item of work 15 has been pushed up the inclined infeed and is proceeding toward the rear of the apparatus, a second item of work 15 (five more 2×4s) may be manually loaded between the flights of the chains 83R, 83L now on the inclined infeed. When said second item of work has been pushed up the inclined infeed and is proceeding toward the rear of the apparatus, a third item of work may be manually loaded between the flights of the chains row on the inclined infeed, and so on for as many items of work as there are in the entire run. The chains are driven slowly enough to permit the loading without stopping them. Each successive item of work 15 undergoes the sawing, rounded-end shaping, and discharge down the inclined rear ramps as above described.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A method of forming timbers with rounded ends, each timber having opposite narrow sides, opposite broad sides extending between the narrow sides, and opposite ends, the method comprising feeding work in a predetermined path with the work extending transversely to the direction of feed, the work comprising a plurality of timbers organized in engagement with one another extending across said path to constitute the work, each timber having opposite ends to be rounded, and as the work is thusly fed, shaping the ends to rounded form by cutting the ends of the work to curve from one narrow side of each end to an opposite narrow side of the respective end, wherein the timbers are 2×4s and are organized to constitute the work with the broad sides thereof in face-to-face engagement, and are fed as a group in the direction perpendicular to the broad sides as they are shaped.

2. The method of claim 1 wherein the work is cut to predetermined length as it is fed before shaping the ends to rounded form.

3. The method of claim 1 wherein both ends are simultaneously shaped to rounded form in a single pass.

4. The method of the claim 1 wherein said plurality of timbers organized in engagement with one another are cut to predetermined length as the work is they are fed before cutting the ends of each timber to rounded form.

5. The method of the claim 4 wherein both ends are simultaneously shaped to rounded form in a single pass.

6. Apparatus for forming timbers with rounded ends comprising an elongate frame, a system for feeding work comprising at least one timber which has opposite ends to be rounded in a predetermined path with the timber extending transversely to the direction of feed, said work feeding system comprising a conveyor fixed on the frame against movement transversely with respect thereto, a carrier movable transversely on the frame, a conveyor mounted on the carrier for transverse movement therewith toward and away from the fixed conveyor, each conveyor having at least one pusher engageable with the work adjacent a respective end thereof for pushing it along said path, the carrier-mounted conveyor being movable with the carrier toward and away from the fixed conveyor to adjust it for engagement of the carrier-mounted conveyor pusher with work of different lengths adjacent the respective end of the work, and first and second shapers on opposite sides of said path being engageable with said opposite ends for shaping said ends to rounded form as the timber is thusly fed, the first shaper being mounted on the frame adjacent the fixed conveyor and the second shaper being mounted on the carrier for adjustment therewith, the shapers being arranged to form the ends of the timber to curve from one narrow side of each end to an opposite narrow side of the respective end.

7. Apparatus as set forth in claim 6 having a saw adjacent said predetermined path for cutting the work to predetermined length as it is fed before it encounters the shapers.

8. Apparatus as set forth in claim 6 wherein the shapers are cutters for cutting the respective end to rounded form.

9. Apparatus as set forth in claim 8 wherein the cutters are directly opposite one another on opposite sides of said path, both ends of the timber being simultaneously cut thereby to rounded form in a single pass of the work.

10. Apparatus as set forth in claim 6 having a saw on the carrier for cutting the work to length as determined by the adjustment of the carrier, said saw being mounted on the carrier in position leading the second shaper, which is mounted on the carrier.

11. Apparatus as set forth in claim 10 wherein each shaper comprises a rotary cutter having a drive.

12. Apparatus as set forth in claim 11 wherein each rotary cutter comprises a spinner having a plurality of arcuate cutting edges for the rounded end cutting.

13. Apparatus as set forth in claim 10 having an abutment on the frame adjacent the fixed conveyor for engagement by one end of the work for positioning it endwise, and a length gauge on the frame for facilitating adjustment of the carrier to locate the saw for cutting the work to selected length.

14. Apparatus as set forth in claim 13 wherein the length gauge comprises a foot and inch scale extending lengthwise on the frame and the carrier has an index correlated with the saw readable in conjunction with the scale for setting the distance of the saw from the abutment.

15. Apparatus as set forth in claim 6 wherein the frame has a front and a rear, each conveyor comprising an endless chain trained around sprockets at the front and rear and having pushers for pushing the work in said path from front to rear.

16. Apparatus as set forth in claim 15 having a drive for the chains of both of the conveyors comprising a single shaft extending lengthwise of the frame in driving relation with the rear sprockets, the rear sprocket of the conveyor on the carrier being slidable on the shaft allowing the adjustment.

17. Apparatus as set forth in claim 15 wherein each conveyor has an infeed at the front of the frame slanted downwardly for facilitating loading of work on the chains.

18. Apparatus as set forth in claim 15 wherein each conveyor has a rail alongside the respective chain on which the work is slidable.

19. Apparatus as set forth in claim 18 having hold-downs for holding work down on the rails.

20. Apparatus as set forth in claim 19 wherein the hold-downs are adjustable for use in accommodating timbers of different sizes and orientations into the apparatus.

21. Apparatus as set forth in claim 18 having a timber-grooving instrumentality for grooving the timbers to track on the rails.

22. The method of claim 1 wherein the step of shaping the ends to rounded form comprises shaping the ends to semi-circular form.

23. The method of claim 1 wherein the cut ends of the timber are free of flat surfaces.

24. Apparatus as set forth in claim 6 wherein the rounded form of each of the ends of the timber is semi-circular.

25. Apparatus as set forth in claim 6 wherein the shaped ends of the timber are free of flat surfaces.

26. Apparatus as set forth in claim 11 wherein each cutter includes a central hub and multiple cutter arms extending radially outward from said hub in a spiral configuration.

27. Apparatus as set forth in claim 26 wherein each cutter arm includes a concave recess for rounding the opposite ends of the work.

28. Apparatus as set forth in claim 6 wherein the conveyors are adapted to hold timbers on a narrow side thereof with a broad side of the timber facing in the direction of movement of the timber along the path.

29. Apparatus as set forth in claim 20 wherein the hold-downs comprise compression springs for holding the work down on the rails.

30. Apparatus as set forth in claim 20 wherein the hold-downs comprise rack and pinion gears for holding the work down on the rails.

31. The method of claim 1 wherein feeding the work comprises moving the timbers with a conveyor along the predetermined path past the shapers, the conveyor being adapted to support each timber on a narrow side thereof with a broad side of each timber facing the direction of movement along the path.

32. The method of claim 1 wherein the step of feeding the work comprises organizing the timbers of the work on a narrow side thereof for movement along the predetermined path, the method further comprising simultaneously pressing down on the timbers with a hold-down as they move along the predetermined path.

33. Apparatus as set forth in claim 6 wherein the work comprises multiple timbers and the apparatus further comprises a hold down having a belt, the hold down belt simultaneously pressing the multiple timbers in the work down on the conveyors as the work moves along the predetermined path via the conveyors.

* * * * *